US009079064B2

(12) United States Patent
Hur

(10) Patent No.: US 9,079,064 B2
(45) Date of Patent: Jul. 14, 2015

(54) STRENGTHENING AND REHABILITATION EXERCISE APPARATUS

(76) Inventor: Young-baek Hur, Seongdong-Gu (KR)

( * ) Notice: Subject to any disclaimer, the term of this patent is extended or adjusted under 35 U.S.C. 154(b) by 409 days.

(21) Appl. No.: 13/144,415

(22) PCT Filed: Jan. 22, 2010

(86) PCT No.: PCT/KR2010/000419

§ 371 (c)(1),
(2), (4) Date: Jul. 13, 2011

(87) PCT Pub. No.: WO2010/085111

PCT Pub. Date: Jul. 29, 2010

(65) Prior Publication Data

US 2011/0275500 A1 Nov. 10, 2011

(30) Foreign Application Priority Data

Jan. 23, 2009 (KR) ..... 10-2009-0006071

(51) Int. Cl.
*A63B 23/02* (2006.01)
*A63B 21/00* (2006.01)
(Continued)

(52) U.S. Cl.
CPC ..... *A63B 23/0205* (2013.01); *A61H 1/0292* (2013.01); *A63B 21/00065* (2013.01); *A63B 21/0087* (2013.01); *A63B 21/00181* (2013.01); *A63B 21/0615* (2013.01); *A63B 21/1492* (2013.01); *A63B 21/15* (2013.01); *A63B 22/0089* (2013.01); *A63B 23/0211* (2013.01); *A63B 23/0233* (2013.01); *A61H 2201/1246* (2013.01); *A61H 2201/1269* (2013.01); *A61H 2201/1463* (2013.01);
(Continued)

(58) Field of Classification Search
CPC ..... A63B 23/0205; A63B 21/1492; A63B 21/0615; A63B 22/0089
USPC ..... 482/142, 145, 51, 92, 94, 97, 133–138, 482/140
See application file for complete search history.

(56) References Cited

U.S. PATENT DOCUMENTS 5,142,944 A 9/1992 McArthur et al.
5,300,005 A * 4/1994 Wang ..... 482/142
(Continued)

FOREIGN PATENT DOCUMENTS

JP 7-067980 3/1995
KR 10-0413224 12/2003
(Continued)

*Primary Examiner* — Loan H Thanh
*Assistant Examiner* — Jennifer M Deichl
(74) *Attorney, Agent, or Firm* — Jordan and Hamburg LLP

(57) ABSTRACT

A strengthening and rehabilitation exercise apparatus includes a hip joint strengthening and rehabilitation exercise apparatus for strengthening a pelvis, an abdominal region, and a waist through exercise of a lower body symmetrically interlocking with a weight while fixing an upper body in a prone position, a hip joint strengthening and rehabilitation exercise apparatus for strengthening the pelvis, the abdominal region, and the waist through exercise of the upper body interlocking with the weight while fixing the lower body in a sitting position, a waist joint strengthening and rehabilitation exercise apparatus for strengthening the waist and the abdominal region through exercise of the upper body interlocking with the weight while fixing legs and the pelvis in a straight line in a supine position, and a stretching apparatus for performing muscle exercise of a back and shoulders using hands and arms in the sitting position.

12 Claims, 18 Drawing Sheets

(51) Int. Cl.

| | |
|---|---|
| ***A63B 21/06*** | (2006.01) |
| ***A63B 22/00*** | (2006.01) |
| ***A63B 21/008*** | (2006.01) |
| ***A61H 1/02*** | (2006.01) |
| ***A63B 23/04*** | (2006.01) |
| ***A63B 23/00*** | (2006.01) |
| ***A63B 71/02*** | (2006.01) |
| *A63B 21/005* | (2006.01) |
| *A63B 69/00* | (2006.01) |
| *A63B 71/06* | (2006.01) |

(52) U.S. Cl.

CPC .... *A61H 2201/5071* (2013.01); *A63B 21/0056* (2013.01); *A63B 21/0057* (2013.01); *A63B 21/00069* (2013.01); *A63B 22/0023* (2013.01); *A63B 23/0488* (2013.01); *A63B 2021/0616* (2013.01); *A63B 2021/0617* (2013.01); *A63B 2022/0094* (2013.01); *A63B 2023/003* (2013.01); *A63B 2023/006* (2013.01); *A63B 2069/0062* (2013.01); *A63B 2071/025* (2013.01); *A63B 2071/0658* (2013.01); *A63B 2208/0204* (2013.01); *A63B 2208/0233* (2013.01); *A63B 2208/0252* (2013.01); *A63B 2208/0257* (2013.01); *A63B 2220/56* (2013.01); *A63B 2225/09* (2013.01)

(56) References Cited

U.S. PATENT DOCUMENTS

| | | | | |
|---|---|---|---|---|
| 5,324,247 | A * | 6/1994 | Lepley | 482/134 |
| 5,498,222 | A | 3/1996 | Hur | |
| 5,669,865 | A * | 9/1997 | Gordon | 482/142 |
| 5,928,112 | A | 7/1999 | Jones et al. | |
| 6,168,557 | B1 * | 1/2001 | Liao | 482/140 |
| 6,537,185 | B1 | 3/2003 | Hur | |
| 7,094,188 | B2 * | 8/2006 | Reitz et al. | 482/142 |
| 7,150,702 | B2 * | 12/2006 | Webb et al. | 482/130 |
| 7,223,216 | B1 * | 5/2007 | McBride | 482/121 |
| 7,252,626 | B2 | 8/2007 | Hur | |
| 7,452,308 | B2 * | 11/2008 | Robideau | 482/51 |
| 2002/0111257 | A1 | 8/2002 | Hur | |
| 2005/0143226 | A1 * | 6/2005 | Heidecke | 482/62 |
| 2008/0132383 | A1 * | 6/2008 | Einav et al. | 482/8 |
| 2008/0132385 | A1 * | 6/2008 | Alessandri et al. | 482/52 |

FOREIGN PATENT DOCUMENTS

| | | |
|---|---|---|
| KR | 10-0581273 | 5/2006 |
| KR | 10-0581274 | 5/2006 |
| KR | 10-0762528 | 10/2007 |
| WO | WO-2007/105907 | 9/2007 |

* cited by examiner

STRENGTHENING AND REHABILITATION EXERCISE APPARATUS

BACKGROUND OF THE INVENTION

The present invention relates to a health care solution to discover fundamental causes of regressive diseases due to lack of exercise and reasons why such fundamental causes are not overcome and to investigate a solution of such fundamental causes, and, more particularly, to a strengthening and rehabilitation exercise apparatus that is capable of effectively training a human body including a pelvis, a waist, an abdominal region, a back, and shoulders of the human body while reducing the number of exercise repetitions and exercise burden.

With the advancement of medical technology, infectious diseases have been cured, and the human life span has been increased. However, regressive diseases due to lack of exercise continue to grow rapidly, with the result that geriatric diseases are emerging as a serious social problem. Most of the regressive diseases due to lack of exercise are permanent and are accompanied by pain and a serious disorder. As normal human behavior becomes inconvenient and people become weak, immunity and resistance to diseases are deteriorated, and therefore, people are exposed to various kinds of diseases. As a result, enormous medical expenses are required, which becomes a burden on welfare finance and medical insurance finance. With the change in aspect of diseases, the number of pain patients seeing doctors is increasing rapidly. Approximately 90% of pain patients are women. This indicates that women are not overcoming diseases due to lack of exercise and have not found measures to deal with such diseases yet.

Generally, lumbago is a disease which people frequently experience. Men easily overcome lumbago. In a case in which men endure it, lumbago may naturally disappear. Also, men rarely have a surgical operation unless they have an accident. On the other hand, women suffer deep and continuous pain due to lumbago. In addition, women may have a surgical operation to remedy lumbago even after a long strengthening and rehabilitation. Osteoporosis intensively occurring at a waist and inguinal bones of people frequently appears in women. Also, fracture and necrosis of a hip joint, urinal incontinence, anal prolapse, and loss of sex drive are seen in women due to lack of exercise.

The reason why women are easily exposed to diseases due to lack of exercise unlike men is that women have a weak basic physical strength, and, in addition, they become weaker due to a life cycle including pregnancy, birth, and menopause and due to a long period of lack of exercise.

The above respect is supported by the fact that women in their seventies and eighties rarely exercise. Also, the fact that approximately 90% of the pain patients are women vividly shows that women do not overcome a physical disorder due to lack of exercise.

Therefore, women's diseases due to lack of exercise are more urgent than any other diseases, and women's diseases due to lack of exercise are a present problem which modern medical science must urgently solve.

Hereinafter, an interrelation between physical properties of women and diseases due to lack of exercise will be discussed.

Animals have developed strength and muscles and, in addition, are agile, without distinction between male and female. For a human being, on the other hand, men and women have different physical conditions for the following deep meanings. The placenta of a vertebrae is horizontally supported in a safe state, with the result that the vertebrae exhibits mobility even during pregnancy. On the other hand, the pelvis of a human being is configured in a straight shape in which a pelvic outlet is directed downward, and therefore, pregnancy is very unstable. As a result, women have undergone a tremendous change suitable for pregnancy, fetus protection, and birth. Also, the fact that women have weak muscles and strength but have soft and calm nature is understood as a result of evolution considering birthing.

As is generally known, pelvis muscles are coupled to the rectum, the diuretic organs, the genitals, and the reproductive organs to support the rectum, the diuretic organs, the genitals, and the reproductive organs. The pelvis muscles directly affect the urethra and the anal sphincter. For women, therefore, the pelvis inevitably needs to be exercised. Also, the pelvis is a base for leg exercise to strengthen legs. Therefore, pelvis weakness is a major cause of behavior inconvenience. As can be easily understood from the above description, muscles and ligaments of women's pelvis are soft and weak, and, in addition, the pelvis is weaker due to lack of exercise. Therefore, a problem due to lack of exercise is more serious.

Furthermore, the pelvis is a base of a human body to support weight of the human body. The pelvis is a central shaft of a straight framework of which the upper part supports an upper body of the human body and the lower part is connected to legs of the human body. Hip joints frequently suffer a fracture due to collision between an upper body load action and a reaction of the feet. In a word, the pelvis is configured in a structure in which the rectum, the diuretic organs, the genitals, and the reproductive organs are connected to the surrounding muscles such that the rectum, the diuretic organs, the genitals, and the reproductive organs can be supported. For whole and perfect preservation, therefore, exercise is inevitably required. Also, weak physical properties of women originate from the straight pelvis, and therefore, pelvic exercise is very important for women's health.

Hereinafter, an interrelation between lack of exercise and regressive diseases will be discussed with reference to actual cases and through historical analysis.

Since people do not pay deep attention to exercise on the grounds that lack of exercise is a problem which people must personally solve, there are some misunderstandings and many secrets. Exercise is said to be done. However, there is no detailed description as to which portion of a human body is to be exercised and how and why the human body is to be exercised, and there is no scientific support. Also, diseases caused due to lack of exercise have not been closely examined, and incorrect information on diseases caused due to lack of exercise is recognized as truth. An insistence that, since a result of examination reveals that life habits of old people are not different from those of young people, regressive diseases originate from genetics, not lack of exercise is an example of such incorrect information. Of course, all creatures have evolved for survival, and a human being has also evolved for upright walking. Therefore, it is insisted that a problem related to lack of exercise cannot be caused. However, this is a biological conclusion in all aspects.

Regression of a human being occurs due to dynamic reasons in which the human being stands up straight against gravity. Therefore, it is standard practice that this problem must be analyzed from ergonomic, mechanical and physical points of view.

Since a human being stands up straight against gravity, pressure is vertically applied to the waist and the pelvis of the human being. When ligaments, muscles, and disc tissues become loose and degenerate, therefore, the pelvis and the waist supporting the weight of the human being do not endure weight pressure in which the pelvis and the waist are pulled, rubbed, and pressed, with the result that the human being suffers pains in the pelvis and the waist, and the pelvis and the waist are injured. While the human being is put in plaster two or three months for bonesetting, bones and muscles atrophy. In like manner, the pelvis and the waist are a muscle framework which degenerates if the pelvis and the waist are not exercised. This is supported by a fact that osteoporosis intensively occurs at waist bones and leg bones of a hip joint of the human being.

Regressive diseases due to lack of exercise, such as lumbago, urinary incontinence, and osteoporosis, originate from weakness of the waist and the pelvis of the hip joint. Therefore, regressive diseases due to lack of exercise are a physical phenomenon occurring as a result of weak waist and pelvis not supporting body weight. This is a ground proving a fact that the upright structure of a human being is not biologically continued but is preserved by upright walking.

In Korea, for example, diseases due to lack of exercise, such as osteoporosis and urinary incontinence, were unfamiliar before the 1990s, prior to which people walked much more frequently; however, such diseases are very common these days in which people rarely walk. Therefore, it is an undeniable fact that approximately 90% of regressive diseases originate from lack of exercise, such as not walking.

In Korea, the same generation of people has experienced an age having no regressive diseases and an age having common regressive diseases, and therefore, it is possible to vividly know causes, progresses, and results of regression. Any scientific analysis or experimental research as to diseases due to lack of exercise cannot disclose facts revealed in Korea. Consequently, it is understood that Korean circumstances are a secure case from which it is possible to closely examine a problem related to regression due to lack of exercise.

Hereinafter, a problem related to regression of the waist and the pelvis will be discussed through dynamic analysis of an upright mechanism.

The upright structure of a human being is configured in a very unstable inverted triangular structure in which the heavy upper body is supported by the waist. In actuality, however, upright structure of a human being is a very stable mechanism. The waist supporting the upper body has a burden increased in proportion to the bending angle of the waist. When lifting a heavy load, the waist is more dangerous. However, psoas major muscles connected between the legs and the wait directly support the waist in front, and therefore, a critical situation is avoided. The psoas major muscles are leading muscles of a hip joint which disperse burden of the waist to the legs to achieve dynamic stability, support the upper body based on the legs and enable the lower body to move.

Also, the psoas major muscles are directly connected between leg bones and a waist bone, and therefore, it should be understood that the psoas major muscles are a sole root to strongly reinforce the waist joint through leg exercise. Unlike the arms and the legs, the body is maintained upright with little motion, and therefore, exercise of the psoas major muscles through leg activity is the core of waist preservation.

Unlike an erector spine muscle connected to the extreme tip of the lumbar vertebrae, the psoas major muscles are widely attached to opposite sides of the waist bone at the front of the waist bone and are directly connected to the leg bones. Consequently, the exercise effect of the psoas major muscles affected by leg exercise is direct and very great.

Exposure of a human being, who stands up straight, to regressive diseases due to lack of exercise originates from weakness of the psoas major muscles. As is proved by a fact that osteoporosis intensively occurring at the leg bones and the inguinal bones to which the psoas major muscles are connected, regression due to lack of exercise results in weakness of the pelvis and the waist due to lack of hip joint exercise.

Hereinafter, a function of the abdominal region as a mechanism to maintain an upright posture will be described.

The framework of a human being is configured to be bent frontward, and the operation of the arms is also performed in front. As a result, a load of the upper body leans frontward. When viewing the framework of the human being from the side, the spine is erected at the rear part of the framework, and the front part of the framework is empty. Therefore, it seems that the framework of the human being is very unstable. In actuality, however, the body is supported at front and rear although this is not visible. When lifting a heavy load or exerting oneself, even when getting angry or laughing, force is applied to the abdominal region. When the waist is at a critical moment, the critical moment may be avoided by the abdominal region supporting the waist.

Dynamically, application of force to the abdominal region when lifting a heavy load or exerting oneself is an evidence showing that the abdominal region is a base for physical activity. According to the third law, an exercise base represents a capacity to generate force, and therefore, the abdominal region represents a capacity of the body and physical strength. Also, since the abdominal region is a base of physical strength to maintain force, the abdominal region is related to endurance. The abdominal region, as illustrated by Leonardo da Vinci's sculptures and wall painting in Rome, symbolizes force and physical strength, which is also supported by the origin of words, such as courage, brave, and large-scale thinking.

Therefore, a well-developed abdominal muscle can sufficiently cover weakness of the waist and low physical strength. Also, the well-developed abdominal muscle can tightly pull even the flank. Therefore, the well-developed abdominal muscle is a major point of an S line. The abdominal muscle exhibits tolerance to diseases in addition to physical effects as described above, thereby functioning as a very important factor of health and high physical strength.

As previously described, it has been confirmed through the substantial experience, dynamic analysis, and the upright mechanism of the human body that more than 90% of regression causes originate from lack of exercise. As previously revealed, regressive changes occur at the pelvis and waist regions supporting the body weight due to comfortable lift habits. However, the waist, the abdominal region, and the pelvis, which support the upper body, have a large weight burden. Therefore, the waist, the abdominal region, and the pelvis need to be exercised but are not easily exercised. Since the waist, the abdominal region, and the pelvis have little exercise effect, it is difficult to produce good results in a short period of time. In addition, it is impossible for patients, women, and the old and the weak to exercise the waist, the abdominal region, and the pelvis. This is a reason for which regressive diseases become chronic and inveterate and frequently recur after the administration of medicine. The fat that pain patients whose behaviors are inconvenient due to geriatric diseases go on rapid growing every hospital and the fact that there are many medicines and medicine administration methods prove that there is no proper and precise method of treatment.

As a measure to partially solve the above problems and achieve a desired object, the inventor of the present application has proposed exercise apparatuses disclosed in U.S. Pat. Nos. 5,498,222 and 6,537,185. The disclosed exercise apparatuses are advantageous in that the exercise apparatuses may have various shapes, and therefore, it is possible to move the upper body or the lower body about the waist, thereby training the waist. However, the disclosed exercise apparatuses are disadvantageous in that a large amount force is initially required to perform waist exercise, whereby it is difficult for women or the old and the weak capable of exerting relatively small force to use the exercise apparatuses, and, particularly, the exercise apparatuses are not suitable for strengthening and rehabilitation treatment. The pelvis, the waist, the back, and the shoulders have little exercise effect through ordinary exercise, and there are no methods suitable for women or the old and the weak.

Also, an exercise method of directly moving the waist, which is structurally very weak, may be carried out. In this method, however, weight exercise is not possible because the waist joint is the symmetrical middle between the upper body and the lower body, and therefore, one of the upper and lower bodies is strained when exercise resistance is applied to the other. Also, upper body muscles, such as the neck and the shoulders, are strained, although exercise without exercise equipment is performed, and therefore, it is difficult to continuously perform such exercise without exercise equipment.

Of course, waist joint exercise is an exercise for enhancing muscular strength between the pelvis and the spine, and therefore, it is possible to stabilize an exercise base through the fixation of the pelvis. The pelvis is merely ⅕ the length of the spine. For this reason, it is necessary to fix the pelvis using physical force equivalent to 5 times exercise torque, which is not substantially possible.

Furthermore, the front part of the pelvis is buried in the inguinal muscles in a sitting position, with the result that it is not possible to fix the pelvis. Also, the waist is configured in a weak structure having bone joints without a supporting framework. In addition, the waist is a very sensitive region through which leg nerves extend. If the pelvis is not securely fixed, the center of exercise is shifted from the waist to the hip joint, and, in addition, strong force is shifted from the waist to the hip joint. For this reason, the pelvis must be fixed during waist exercise.

In this aspect, the prior art disclosed in U.S. Pat. No. 5,928,112 relates to a method of fastening the knees and the inguinal regions on a seat board in a sitting position with the knees drawn high. In this method, the legs and the pelvis are tightly disposed between a footstool and a pelvis rest, whereby the physical fixing of the legs and the pelvis is achieved. During waist exercise, however, force is applied even to the footstool, and the front part of the pelvis is opened, with the result that the movement of the pelvis is caused.

That is, repulsive force is substantially applied to the footstool during waist exercise. As a result, this is not different from a method of lifting a load while stamping feet.

For this reason, the above conventional technology has been denounced in aspects of stability and efficiency in a muscular strength test and a strengthening and rehabilitation process. A value of muscular strength displayed on a display is not an inherent muscular strength of the waist but a value containing leg force. Also, errors may be caused during the execution of a back muscle test.

Also, the prior art disclosed in U.S. Pat. No. 6,116,143, which has been proposed by the inventor of the present application, adopts an optimal pad fixing method of pressing the inguinal regions and the pelvis using uniform pressure, thereby providing the effects of fixing the legs and the pelvis and somewhat eliminating pain occurring when fixing the legs and the pelvis. However, it is difficult to apply fixing pressure sufficient to fix the pelvis, with the result that the disclosed method is limited in selecting various exercise loads. Therefore, it is not easy for patients as well as the old and the weak to use this method. Also, it is difficult to select exercise loads suitable for individual users. In addition, it is not possible to solve a problem caused due to lack of body exercise although a problem related to the waist exercise is solved.

SUMMARY OF THE INVENTION

Therefore, the present invention has been made in view of the above problems, and it is an object of the present invention to provide a strengthening and rehabilitation exercise apparatus that is capable of easily training an upright core to effectively deal with regressive diseases while discovering fundamental causes of the regressive diseases and reasons why such fundamental causes are not overcome.

The waist and the pelvis supporting the upper body of a human body have little exercise effect, with the result that the waist and the pelvis are regions where fat easily accumulates and are difficult to exercise. Therefore, it is another object of the present invention to provide a strengthening and rehabilitation exercise apparatus that is capable of solving the above problem using a principle of pendulum motion and gravity.

It is another object of the present invention to provide a strengthening and rehabilitation exercise apparatus that is capable of training an upright core including legs, a pelvis, a waist, and an abdominal region of a human body using a direct exercise therapy and stretching a back and shoulders of the human body, thereby fundamentally solving a problem related to regression of the human body.

In a conventional hip joint bending exercise method, back and shoulder muscles of a human body are strained against leg exercise force of the human body. Therefore, it is another object of the present invention to provide a strengthening and rehabilitation exercise apparatus that is capable of performing hip joint exercise in a prone position such that the hip joint exercise is not affected by gravity, thereby solving the problem caused in the conventional hip joint bending exercise method.

In a conventional waist joint exercise method, a pelvis of a human body is incompletely fixed. Therefore, it is another object of the present invention to provide a strengthening and rehabilitation exercise apparatus that is capable of safely and easily training an abdominal muscle and a waist muscle using a principle of pendulum motion and gravity while simultaneously fixing the inguinal regions and the pelvis of a human body in a supine position.

It is another object of the present invention to provide a strengthening and rehabilitation exercise apparatus that is capable of moving the legs of a human body in a seesaw fashion while the legs of the human body are supported on a four-axis link arranged in parallel in a prone position, thereby performing exercise using inertia, linking an inguinal region exercise lever to a lever having a weight mechanism of an exercise resistance controller in a symmetrical structure to minimize initial exercise load, thereby reducing exercise burden, and inducing strong weight resistance using inertia, thereby providing the same exercise effect.

It is another object of the present invention to provide a strengthening and rehabilitation exercise apparatus that is capable of precisely adding or subtracting weight resistance using a weight mechanism or an electromagnetic brake and an amplifier such that it is possible for anyone to use the strengthening and rehabilitation exercise apparatus with reduced exercise burden, and performing warm-up exercise and cooldown exercise having a stretching function using the same strengthening and rehabilitation exercise apparatus, thereby further expanding user convenience.

It is another object of the present invention to provide a strengthening and rehabilitation exercise apparatus that is capable of more easily performing hip joint exercise based on a footstool in a tensioned state in which a lumbar joint of a human body is pulled.

It is another object of the present invention to provide a strengthening and rehabilitation exercise apparatus, configured to bend or straighten a spine of a human body while fixing a pelvis and legs of the human body, wherein a technique for simultaneously fixing the pelvis and thighbones of the human body in a standing position is used, waist exercise is muscular strength exercise performed between the pelvis and the spine of the human body about the waist joint of the human body, secure fixing of the pelvis of the human body is achieved based on symmetrical exercise between the upper body and the lower body of the human body, thereby stabilizing an exercise base, a fixing mode in which the pelvis and the inguinal regions of the human body are arranged in a supine position is adopted to correspond to an exercise center axis of the spine of the human body in the same conditions, and it is possible to fundamentally prevent the occurrence of an interlocking phenomenon and force dispersion during waist joint exercise, thereby stably and efficiently performing waist joint exercise while securing an exercise base for the waist joint of the human body.

It is another object of the present invention to provide a strengthening and rehabilitation exercise apparatus that is capable of securely stabilizing an exercise base for a waist joint of a human body to induce muscular contraction with the maximum resistance force, thereby achieving maximal exercise effects while reducing the number of exercise repetitions.

It is another object of the present invention to provide a strengthening and rehabilitation exercise apparatus configured such that, at the beginning of exercise, a seesaw exercise function is provided in which weight load of a lever symmetrically rotated about an exercise center axis is minimized, thereby reducing initial exercise burden based on inertia of pendulum motion, the strengthening and rehabilitation exercise apparatus is fixed in the same direction as gravity to offset of muscle strain, thereby preventing a reflexive nerve response, and exercise load is controlled based on displacement of a weight and resistance of a power brake, thereby performing effective waist exercise.

It is another object of the present invention to provide a strengthening and rehabilitation exercise apparatus configured such that an inertial exercise function is adopted to accommodate a load of a weight increasing according to a tiling angle at which exercise is performed without burden, thereby inducing muscular contraction with the maximum resistance force and achieving a function as an effective exercise medium, with the result that it is possible to obtain an exercise effect although exercise time is reduced or exercise efforts are diminished.

It is another object of the present invention to provide an exercise resistance controller that is capable of obtaining exercise torque based on displacement of a weight configured to perform pendulum motion and resistance force of a powder brake including an amplifier.

It is a further object of the present invention to provide a solution that is capable of fundamentally solving a problem caused due to lack of exercise through stretching of a pelvic joint, a back, and shoulders of a human body.

In accordance with the present invention, the above and other objects can be accomplished by the provisions of a strengthening and rehabilitation exercise apparatus for training a pelvis, a waist, a back, and shoulders of a human body in a standing position, a supine position, or a prone position to prevent and cure regressive diseases, the strengthening and rehabilitation exercise apparatus including: a hip joint strengthening and rehabilitation exercise apparatus for strengthening the pelvis, an abdominal region, and the waist of the human body through exercise of a lower body of the human body symmetrically interlocking with a weight while fixing an upper body of the human body in the prone position; a hip joint strengthening and rehabilitation exercise apparatus for strengthening the pelvis, the abdominal region, and the waist of the human body through exercise of the upper body of the human body interlocking with the weight while fixing the lower body of the human body in a sitting position; a waist joint strengthening and rehabilitation exercise apparatus for strengthening the waist and the abdominal region of the human body through exercise of the upper body of the human body interlocking with the weight while fixing the legs and the pelvis of the human body in a straight line in the supine position; and a stretching apparatus for solving back and shoulder muscle strain and pain through muscle exercise of the back and the shoulders of the human body using hands and arms of the human body in the sitting position, thereby sequentially solving lack of exercise in an integrated manner.

The hip joint strengthening and rehabilitation exercise apparatus may be configured in a structure in which an exercise frame is mounted at a stationary frame of the exercise apparatus such that the human body is placed on the exercise frame in the prone position, the exercise frame comprises an upper frame and a lower frame coupled to the upper frame, and a rotary shaft located midway between the upper frame and the lower frame is mounted at one side of the stationary frame such that the rotary shaft interlocks with a hip joint axis of the human body, thereby strengthening the pelvis, the abdominal region, and the waist of the human body through the exercise of the upper body or the lower body of the human body in the prone position in which the human body lies prone on the exercise frame.

The upper body or the lower body of the human body may be fixed, and an exercise resistance controller may be connected to the rotary shaft located at the exercise frame at the opposite side thereof. The exercise resistance controller may be provided with a lever that performs symmetrical rotation while interlocking with the exercise frame, and the lever may be provided with a weight mechanism, thereby providing an exercise load function to induce resistance against gravity and a gravity offset function and easily inducing heavy weight exercise using small force through pendulum motion based on inertia.

The lower frame of the exercise frame may include an inguinal region exercise lever interlocking with the rotary shaft, a four-axis link coupled to the inguinal region exercise lever such that the four-axis link rotates in parallel, and a calf rest coupled to a lower end of the four-axis link such that a length of the calf rest can be adjusted according to a length of each of the inguinal regions of the human body by a motor, thereby providing an inertial exercise function.

The exercise resistance controller may include a brake wheel mounted at the rotary shaft of the weight mechanism and an additional electromagnetic brake and an amplifier interlocking with the brake wheel.

The hip joint strengthening and rehabilitation exercise apparatus may be configured in a structure in which a footstool and a knee rest whose height is adjustable are mounted at a lower end of a stationary frame having a sliding board, a seat board exercise frame is slidably mounted at the sliding board, and an exercise resistance controller interlocking with the seat board exercise frame is mounted at the stationary frame such that the seat board exercise frame is moved downward in a tensioned state in which a lumbar joint of the human body is pulled by the exercise resistance controller connected to an upper body rest, thereby achieving hip joint strengthening and rehabilitation exercise based on the footstool.

The waist joint strengthening and rehabilitation exercise apparatus may include a calf rest provided at the front thereof to support calves of the human body such that inguinal regions of the human body or both the inguinal regions and the pelvis of the human body are fixedly arranged in line in the supine position, an inguinal region and pelvis rest is provided at a rear of the calf rest to support the inguinal regions of the human body or simultaneously rest the inguinal regions and the pelvis of the human body, a calf fixing unit located above the calf rest to press and fix the calves of the human body when the waist joint strengthening and rehabilitation exercise apparatus is operated, an inguinal region and pelvis fixing unit located above the inguinal region and pelvis rest to press and fix the inguinal regions and the pelvis of the human body, and a backboard frame constituting a backboard coupled to a stationary frame such that the backboard frame can angularly move about a rotation center shaft. The rotation center shaft may be positioned to coincide with the hip joint or waist joint of the human body, and an exercise resistance controller may be connected to the rotation center shaft such that the exercise resistance controller interlocks with the backboard frame, thereby training the pelvis, the abdominal region, and the waist of the human body through exercise performed by bending and straightening the upper body of the human body about the hip joint or the waist joint of the human body.

The inguinal region and pelvis rest may be fixed to the stationary frame, the backboard frame constituting the backboard may be coupled to the stationary frame such that the backboard frame can angularly move about the rotation center shaft, and the rotation center shaft may be positioned to coincide with the waist joint of the human body. The exercise resistance controller may be connected to the rotation center shaft such that the exercise resistance controller interlocks with the backboard frame, the exercise resistance controller may be configured in a structure in which a lever is mounted such that the lever is symmetrically rotated about the rotation center shaft while interlocking with the backboard including the backboard frame, and the lever is provided with a weight mechanism, thereby providing a gravity offset function to offset gravity of the backboard, an exercise load function to add and subtract exercise resistance, and an inertial exercise function to induce weight resistance to muscles and to eliminate a psychological burden using inertia. The backboard frame may be configured in a double shape such that the height of the backboard frame can be adjusted, a headrest may be mounted at the upper part of the backboard frame such that the headrest can be moved backward and forward, an upper body fixing mechanism may be mounted at the upper part of the backboard frame, and the exercise resistance controller may include an additional brake wheel mounted at the rotation center shaft and an additional electromagnetic brake and an amplifier interlocking with the brake wheel.

The calf fixing unit may be mounted at one side of the stationary frame such that the calf fixing unit can be rotated about a first hinge part, the inguinal region and pelvis fixing unit may be mounted at the calf fixing unit such that the inguinal region and pelvis fixing unit can be rotated about a second hinge part, the calf rest may be mounted at the other side of the stationary frame such that the calf rest can be rotated about a third hinge part, a pair of armrest-shaped press links may be mounted at the other end of the stationary frame such that the armrest-shaped press links can be rotated about a fourth hinge part, and press guide rails may be fixed at opposite sides of the inguinal region and pelvis fixing unit such that the press links press the press guide rails in an operating state, and the pressing operation is released in a non-operating state. The calf fixing unit, the calf rest, and the press links may be coupled to a first rectilinear screw motor, a second rectilinear screw motor, and a third rectilinear screw motor mounted inside the stationary frame, respectively, thereby fixing the inguinal regions of the human body or the pelvis including the inguinal regions of the human body or releasing the fixed state through reciprocating movement of expansion and contraction. The calf rest, the inguinal region and pelvis rest, the calf fixing unit, and the inguinal region and pelvis fixing unit may be connected with respective fixing press members at regions contacting the human body. Each of the fixing press members may include a soft part and a hard part configured to coincide with a skeleton of the human body.

The stretching apparatus may include a seat board provided at a stationary frame, a backboard provided at a rear of the seat board, armrests provided at opposite sides of the backboard such that angles of the armrests can be changed about hinge parts, and grips provided at the armrests such that the grips can slide forward and backward. A first exercise resistance controller configured to transmit exercise resistance force to the grips may include a pneumatic system that can be controlled by a valve and a sensor, thereby stretching the shoulders of the human body through the stretching apparatus.

The backboard may be mounted at a rotary shaft of the stationary frame, and horizontal rotation about a spine of the human body may be achieved using the armrests including the grips and the backboard, while the pelvis and the legs of the human body are fixed, to stretch a waist joint and muscle around the waist joint. A pair of main shafts interlocking with each other by main shaft gears which engage with each other may be mounted at the stationary frame, footstools interlocking with the main shafts may be mounted in front of the main shafts below the main shafts, inguinal region exercise boards interlocking with the main shafts may be mounted in front of the main shafts above the main shafts, and an additional second exercise resistance controller may be provided such that the second exercise resistance controller interlocks with the main shafts, thereby training an adductor muscle and an abductor muscle of a pelvic joint of the human body.

The pneumatic system, which can be controlled by the valve and the sensor, of the exercise resistance controller to transmit exercise resistance force to the grips may include an air cylinder configured to be operated by rectilinear movement of a reduction motor screw, an exercise load cylinder having an excessive air input detection sensor interlocking with the air cylinder, and a pneumatic pressure supply control line connected between the air cylinder and the exercise load cylinder for controlling the supply of pneumatic pressure. A pair of electronic pressure sensors may be mounted in a middle of the pneumatic pressure supply control line, and an air pressurization solenoid valve, a backward flow prevention check valve, and an exhaust solenoid valve may be mounted between the electronic pressure sensors.

According to the hip joint strengthening and rehabilitation exercise apparatus of the present invention, it is possible to move the legs of the human body in a seesaw fashion while the legs of the human body are supported on the four-axis link arranged in parallel in the prone position, thereby performing exercise using inertia. Also, the inguinal region exercise lever is linked to the lever having the weight mechanism of the exercise resistance controller in a symmetrical structure to minimize initial exercise load, thereby easily performing hip joint strengthening and rehabilitation exercise using inertia while reducing exercise burden. If necessary, strong weight resistance may be reduced to provide the same exercise effect. The weight resistance is precisely added or subtracted by the weight mechanism, and therefore, it is possible for anyone to use the hip joint strengthening and rehabilitation exercise apparatus with reduced exercise burden. Also, it is possible to perform warm-up exercise and cool-down exercise having a stretching function using the hip joint strengthening and rehabilitation exercise apparatus, thereby further expanding user convenience. According to a modification of the hip joint strengthening and rehabilitation exercise apparatus of the present invention, it is possible to more easily perform hip joint strengthening and rehabilitation exercise based on the footstool in a tensioned state in which the lumbar joint of the human body is pulled.

Also, according to the waist joint strengthening and rehabilitation exercise apparatus of the present invention, configured to bend or straighten the spine of the human body while fixing the pelvis and the legs of the human body, a technique for simultaneously fixing the pelvis and thighbones in a standing position is used. Waist exercise is muscular strength exercise performed between the pelvis and the spine of the human body about the waist joint of the human body. Secure fixing of the pelvis of the human body is achieved based on symmetrical exercise between the upper body and the lower body of the human body, thereby stabilizing an exercise base. A fixing mode in which the pelvis and the inguinal regions of the human body are arranged in a supine position is adopted to correspond to an exercise center axis of the spine of the human body in the same conditions. It is possible to fundamentally prevent the occurrence of an interlocking phenomenon and force dispersion during waist joint exercise, thereby stably and efficiently performing waist joint exercise while securing an exercise base for the waist joint of the human body. The exercise base for the waist joint of the human body is securely stabilized to induce muscular contraction with the maximum resistance force, thereby achieving maximal exercise effects while reducing the number of exercise repetitions. Also, at the beginning of exercise, a seesaw exercise function is provided in which the weight load of the lever symmetrically rotated about the exercise center axis is minimized, thereby reducing initial exercise burden. An inertial exercise function is adopted to accommodate a load of the weight increasing according to a tiling angle at which exercise is performed without burden, thereby inducing muscular contraction with the maximum resistance force and achieving a function as an effective exercise medium. Consequently, it is possible to obtain an exercise effect although exercise time is reduced or exercise efforts are diminished.

In addition, according to the strengthening and rehabilitation exercise apparatus for stretching and adductor and abductor muscle training of the present invention, exercise about the hip joint of the human body is performed in a sitting position, thereby strengthening and rehabilitating a sphincteral muscle, a pectineous muscle, an adductor muscle, and an adductor muscle of the pelvis of the human body. It is possible to train back and shoulder muscles of the human body in a state in which arms of the human body are straightened. Also, it is possible to stretch the strained waist joint and the muscle around the waist joint through rotation about the spinal line of the human body, thereby effectively training, strengthening, and rehabilitating the pelvis, the waist, the back, and the shoulders of the human body, which may be weak due to lack of exercise.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
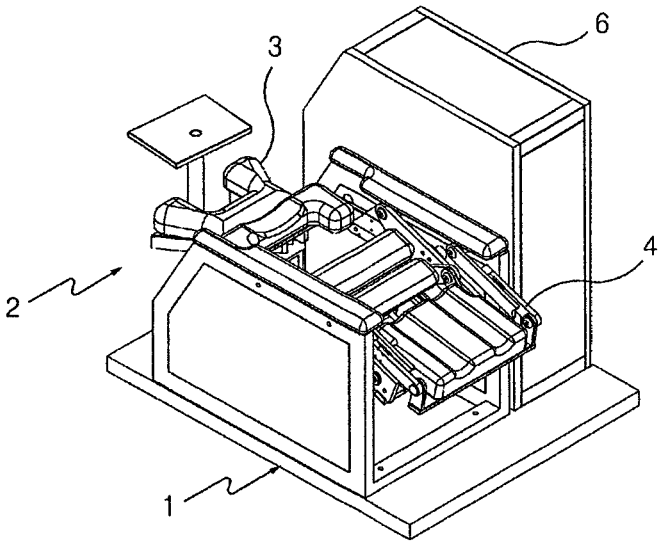
FIG. 1 is a perspective view illustrating the external appearance of a strengthening and rehabilitation exercise apparatus according to an embodiment of the present invention.
Figure 2:
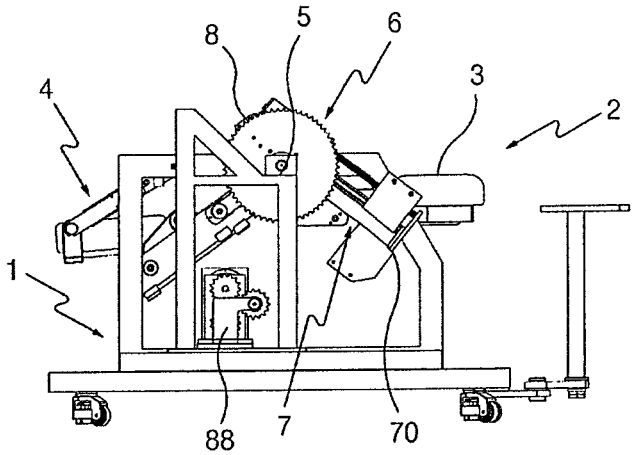
FIG. 2 is a partially omitted right side view of FIG. 1.

According to an embodiment of the present invention as shown in FIGS. 1 to 12, a strengthening and rehabilitation exercise apparatus is configured in a structure in which an exercise frame 2, constituting a framework of the strengthening and rehabilitation exercise apparatus, configured to allow a human body to lie prone at the top thereof is mounted at a stationary frame 1, the exercise frame 2 includes an upper frame 3 and a lower frame 4, a rotary shaft located at the middle between the upper frame 3 and the lower frame 4 is mounted at one side of the stationary frame 1 such that the rotary shaft 5 interlocks with a hip joint axis of the human body, thereby performing exercise of an upper body or a lower body of the human body, in the prone position in which the human body lies prone at the top of the exercise frame 2, to strengthen the pelvis, the abdominal region, and the waist of the human body.

The stationary frame 1 is configured in a structure which is disposed over the side and bottom of the exercise frame 2 to fix the exercise frame 2 in a supported fashion such that the exercise frame 2 can operate.

The upper frame 3 of the exercise frame 2 may be configured in a structure in which a chest rest 30 and a neck rest 32 to support the neck of the human body as well as the head and arms of the human body are mounted at the top of the upper frame 3, and the upper frame 3 is fixed to the stationary frame 1. Alternatively, the upper frame 3 of the exercise frame 2 may be configured in a structure in which one side of the upper frame 3 interlocks with the rotary shaft 5, and the coupling or separation between the stationary frame 1 and the upper frame 3 is achieved by a fixing pin 34 such that the upper frame 3 remains fixed or angularly moves about the rotary shaft 5 in an interlocking fashion.

Also, an exercise resistance controller 6 is connected to the rotary shaft 5 located at the exercise frame 2. The exercise resistance controller 6 is configured in a structure in which the exercise resistance controller 6 is provided with a lever 7 that performs symmetrical rotation while interlocking with the exercise frame 2, and a weight mechanism 70 is mounted at the lever 7 to induce gravitational resistance, thereby providing a gravity offset function, an exercise load function, and an inertial exercise function.

The exercise resistance controller 6 is mounted such that the exercise resistance controller 6 interlocks with the upper frame 3 or the lower frame 4 about the rotary shaft 5. The weight mechanism 70 is mounted at the lever 7. The weight mechanism 70 is threadedly coupled to a screw rod 76 which is spin rotated by a drive motor 74 such that a weight 72 of the weight mechanism 70 moves on the lever 7 along the screw rod 76 according to a direction in which the drive motor 74 is rotated, i.e., a forward direction or a reverse direction of the drive motor 74, thereby achieving displacement thereof.

The lower frame 4 of the exercise frame 2 includes an inguinal region exercise lever 40 interlocking with the rotary shaft 5, a four-axis link 42 coupled to the inguinal region exercise lever 40 such that the four-axis link 42 rotates in parallel, and a calf rest 44 coupled to the lower end of the four-axis link 42 such that the length of the calf rest 44 can be adjusted according to the length of each of the inguinal regions of the human body, thereby providing an inertial exercise function.

That is, the inguinal region exercise lever 40 is coupled to the stationary frame 1 such that opposite sides of the upper part of the inguinal region exercise lever 40 interlock with the rotary shaft 5. A pelvic rest 40*a* and an inguinal region rest 40*b* are disposed at the front of the inguinal region exercise lever 40 such that the pelvic rest 40*a* is located above the inguinal region rest 40*b*. At opposite sides of a middle region of the inguinal region exercise lever 40, a first connection member that is moved up and down by a rectilinear screw motor 41 and a second connection member 45 of the calf rest 44 are connected to each other via a first hinge shaft 46. The other end of the calf rest 44 is connected to a rear lever 47 via a second hinge shaft 48. The upper part of the rear lever 47 is coupled to the stationary frame 1 via a third hinge shaft 49. The inguinal region exercise lever 40, the calf rest 44, and the rear lever 47 constitute the four-axis link 42 by the first and second hinge shafts 46 and 48, the rotary shaft 5 spaced a predetermined distance from the stationary frame 1, and the third hinge shaft 49.

As a screw member 41*a* configured to be spin rotated by the rectilinear screw motor 41 mounted at the inguinal region exercise lever 40 and a first connection member 43 having one side threadedly coupled to the screw member 41*a* move up and down, the height of the calf rest 44 connected thereto is adjusted according to the length of the inguinal regions of a user.

The center of gravity of the weight 72 mounted in the weight mechanism 70 interlocking with the exercise frame 2 is located at a position near to a gravity line, and the weight 72 is located such that the gravity line of the center of gravity is symmetrical to the initial position of joint exercise, thereby easily inducing heavy weight exercise using small force based on inertia.

The exercise frame 2 is configured in a structure in which the lower frame 4 of the exercise frame 2 is fixed, and the upper frame 3 of the exercise frame is movable. Consequently, the lower part of the hip joint of the human body is fixed to the lower frame 4, and exercise is performed using the upper frame 3.

Figure 3:
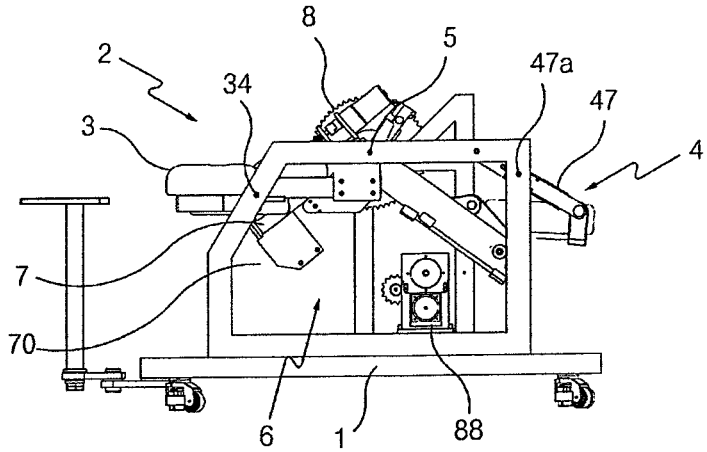
FIG. 3 is a partially omitted left side view of FIG. 1.
Figure 4:
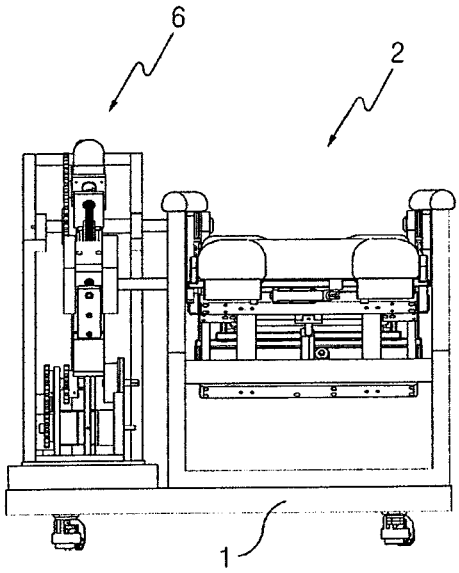
FIG. 4 is a partially omitted front view of FIG. 1.
Figure 5:
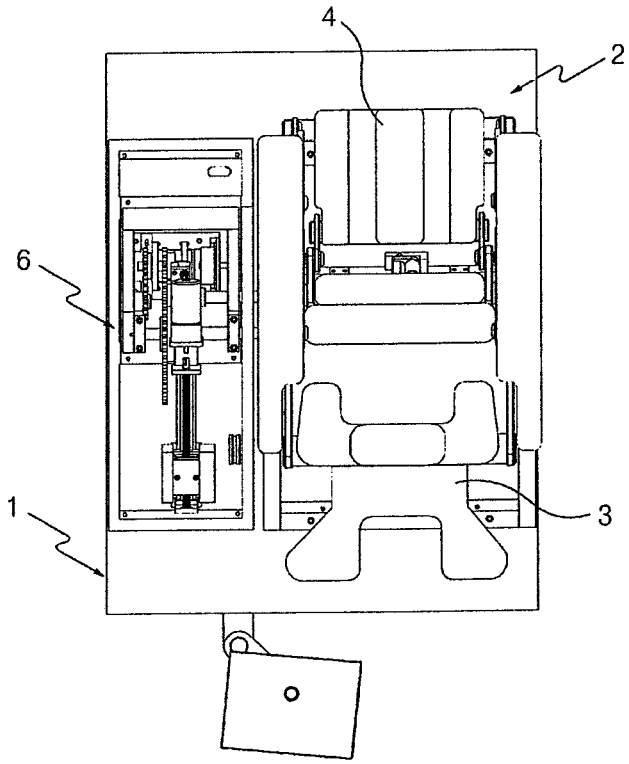
FIG. 5 is a partially omitted top view of FIG. 1.
Figure 6:
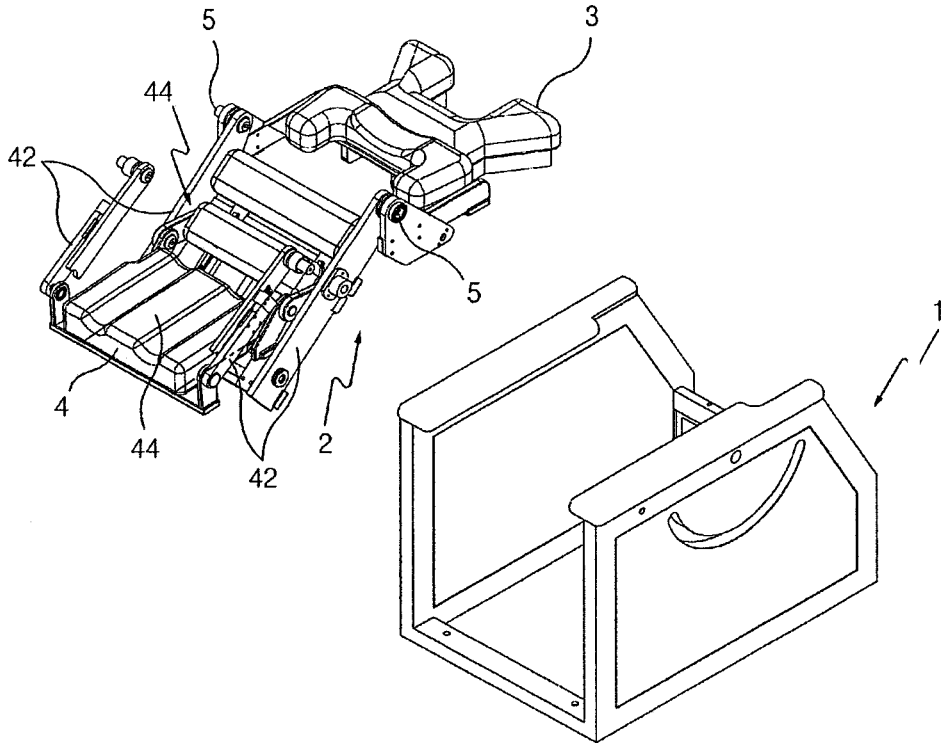
FIG. 6 is a partially omitted exploded perspective view of FIG. 1.
Figure 7:
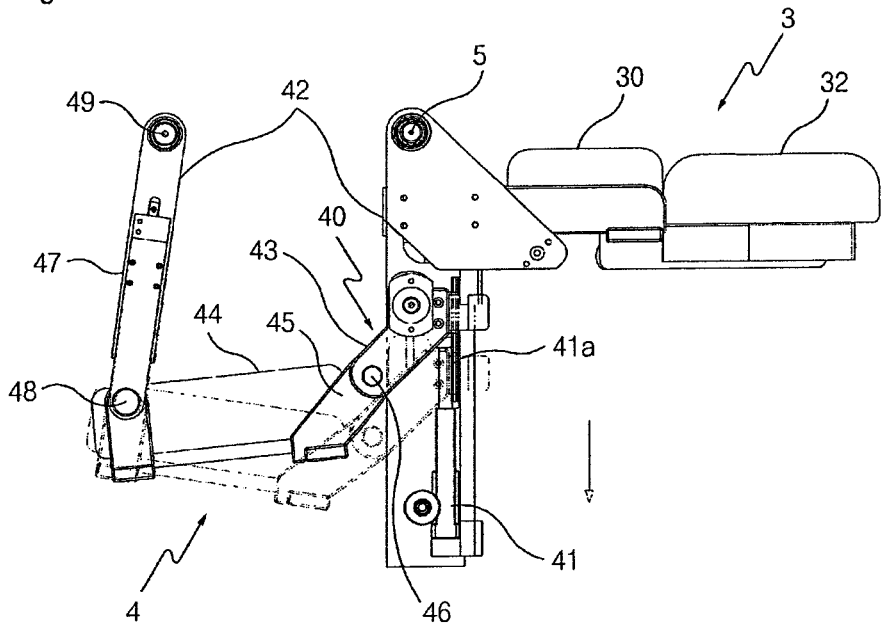
FIG. 7 is an operation state view of an important part of FIG. 6.
Figure 8:
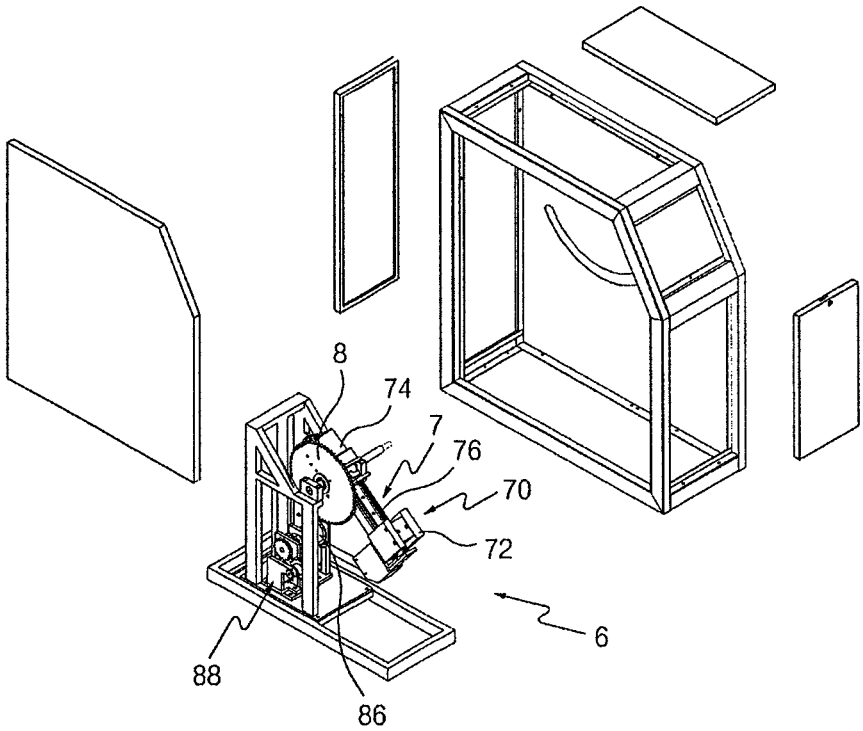
FIG. 8 is an exploded perspective view illustrating an exercise resistance controller adopted in the present invention.
Figure 9:
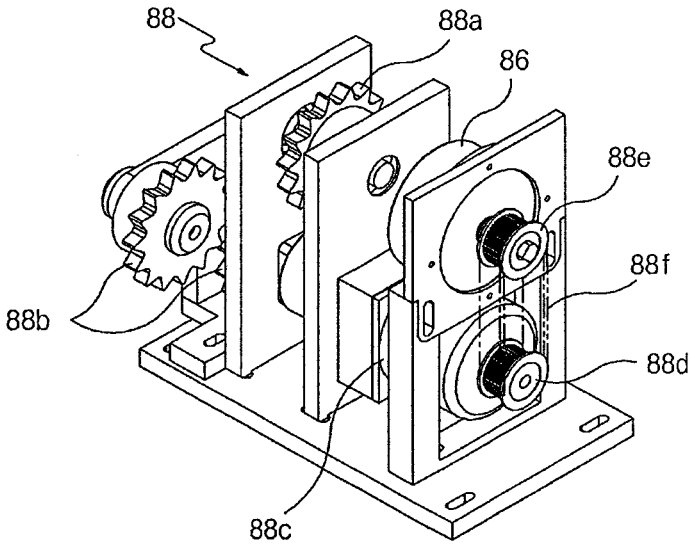
FIG. 9 is a perspective view illustrating the external appearance of an assembly of an electromagnetic brake and an amplifier of the exercise resistance controller adopted in the present invention.
Figure 10:
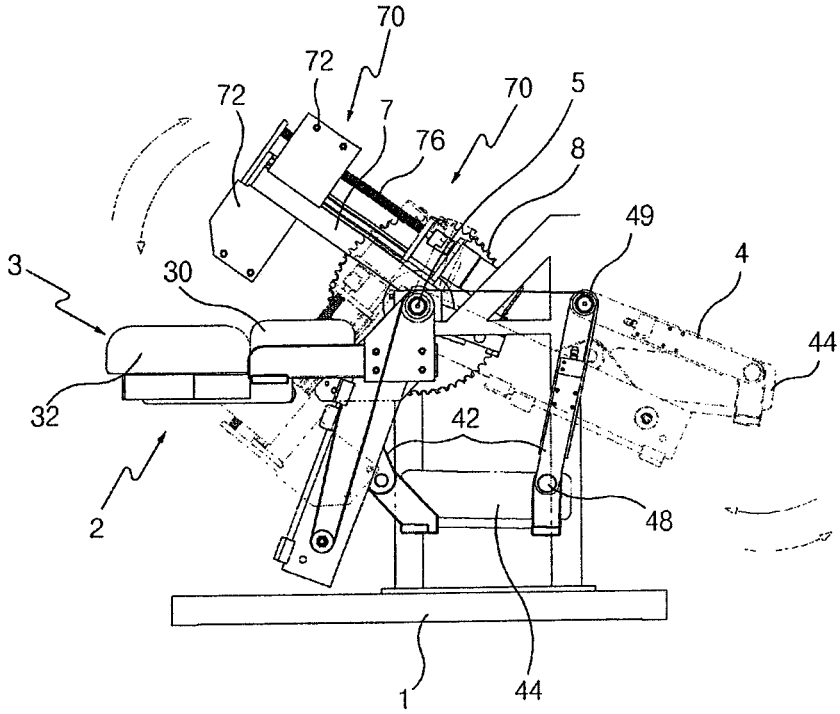
FIG. 10 is an operation state view of the present invention.
Figure 11:
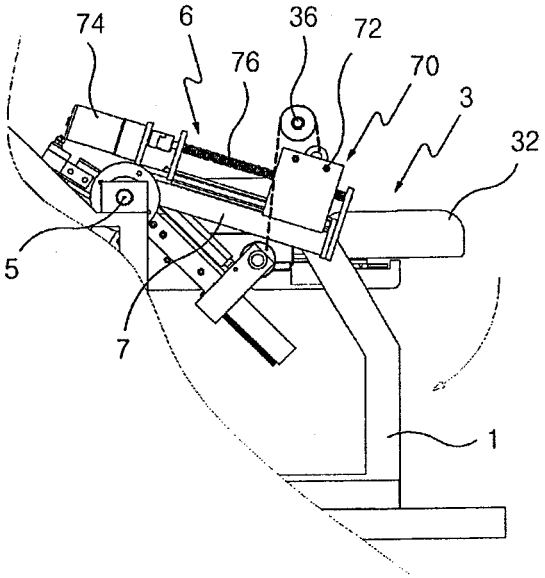
FIGS. 11 and 12 are partially omitted side views illustrating an important part of a strengthening and rehabilitation exercise apparatus according to a modification of the present invention.
Figure 12:
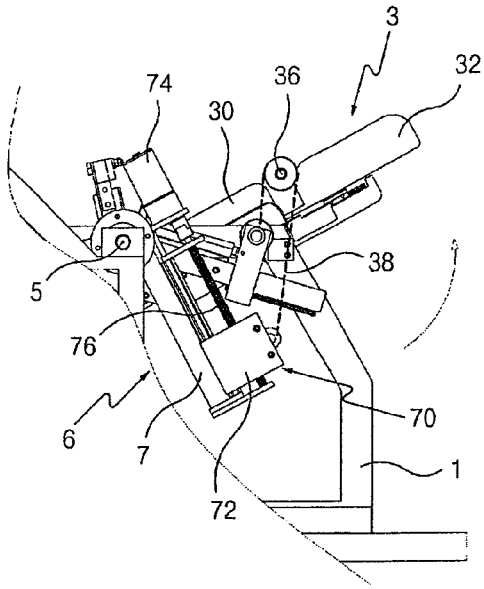

At this time, the lower frame 4 may be fixed, for example, as shown in FIG. 3. The rear lever 47 is fixed to the station frame 1 via a fixing pin 47*a* such that the lower frame 4 is fixed at a specific position. The upper frame 3 is configured to angularly move about the rotary shaft 5 when the fixing pin 34 is separated. The upper frame 3 interlocks with the lever 7 and the weight mechanism 70 of the exercise resistance controller 6 together with the rotary shaft 5. As shown in FIGS. 10 and 11, when the upper frame 3 is pressed downward by the weight of the upper part of the human body, the lever 7 having the weight 72 mounted therein angularly moves about the rotary shaft 5 to move upward. On the other hand, when the pressed state is released such that the upper frame 3 is moved upward, the lever 7 is angularly moved about the rotary shaft 5 by the weight 72 to move downward, with the result that the upper frame 3 is easily moved upward. In this way, the interlocking operation between the upper frame 3 and the lever 7 may be configured to be performed by a rotary roller 36 mounted at the stationary frame 1 and wires 38 fixed at opposite sides of the rotary roller 36 such that the wires 39 extend via the rotary roller 36.

The exercise resistance controller 6 may include an additional brake wheel 8 mounted at the rotary shaft 5, excluding the weight mechanism 70, and an additional electromagnetic brake 86 and an amplifier 88 interlocking with the brake wheel 8.

The electromagnetic brake 86 and the amplifier 88 include a chain gear 88*a* interlocking with the brake wheel 8, a chain gear group 88*b* including a plurality of chain gears interlocking with the chain gear 88*a*, a direct current motor 88*c* interlocking with the chain gear group 88*b*, an electromagnetic brake 86 interlocking with the direct current motor 88*c* via timing gears 88*d* and 88*e* and a timing belt 88*f*.

The electromagnetic brake 86 is configured such that exercise torque is transmitted to the electromagnetic brake 86 by binding of powder and frictional force between the powder and the operation surface thereof due to magnetic flux generated when electric current is supplied to a coil, and necessary exercise torque is selected by controlling voltage applied at this time, thereby adjusting a direction and a load during strengthening and rehabilitation exercise.

Hereinafter, the operation of the strengthening and rehabilitation exercise with the above-stated construction according to the present invention will be described in detail.

First, a preparation process for hip joint strengthening and rehabilitation exercise is performed as follows. In order to adjust the position and distance between the inguinal region exercise lever 40 and the calf rest 44, since different people have the inguinal regions of different lengths with respect to the lower frame 4, a user kneels down on the calf rest 44, and operates the rectilinear screw motor 41 until the hip joint strengthening and rehabilitation exercise apparatus takes an appropriate position. As a result, the screw member 41*a*, which is spin rotated, and the first connection member having one side threadedly coupled to the screw member 41*a* are moved up and down. At this time, the user adjusts the height of the calf rest 44 connected thereto according to the length of his/her inguinal regions. In this way, exercise preparation is completed.

Subsequently, in a case in which hip joint strengthening and rehabilitation exercise is performed using the lower body while fixing the upper body, the exercise may be performed while the upper frame 3 is fixed to the stationary frame 1 by the fixing pin 34.

At this time, the upper body of the user lies prone on the upper frame 3 such that the chest is located at the chest rest 30, and the neck and arms are located at the neck rest 32. The lower body of the user swings in a suspended state by the four-axis link 42 constituted by the inguinal region exercise lever 40, the calf rest 44, and the rear lever 47 about the rotary shaft 5, and the first, second, and third hinge shafts 46, 48, and 49 in a knee bending state in which the pelvis, the inguinal regions, and the shanks of the user are comfortably located at the inguinal region exercise lever 40 and the calf rest 44, thereby achieving exercise about the hip joint of the user backward and forward.

Also, in a case in which hip joint strengthening and rehabilitation exercise is performed using the upper body of the user while the lower body of the user is located in position, the fixing pin 34 is separated such that the upper frame 3 can move about the rotary shaft 5, and the exercise is performed using the upper body of the user while the lower frame 4 is fixed to the stationary frame 1 by the fixing pin 47*a*.

At this time, the shanks of the lower body of the user are located at the calf rest 44 of the lower frame 4, and the inguinal regions of the lower body of the user are in tight contact with the inguinal region exercise lever 40. Also, the upper body comfortably lies prone on the upper frame 3 such that the chest is located at the chest rest 30, and the neck and arms are located at the neck rest 32. In this state, when the upper body presses the upper frame 3, the upper frame 3 angularly moves about the rotary shaft 5, thereby achieving hip joint strengthening and rehabilitation exercise through repetitive upward and downward movement.

When the hip joint strengthening and rehabilitation exercise is performed using the upper body or the lower body of the user, as described above, the weight mechanism 70 of the lever 7 of the exercise resistance controller 6 is operated such that the position of the weight 72 is changed according to the rotation of the screw rod 76 of the drive motor 74. When the exercise is performed using the upper body of the user, the upper frame 3 is used. When the exercise is performed using the lower body of the user, mutual gravitational load is offset using the lower frame 3. In this case, the user can perform exercise in a no load state in which mutual gravitational load is offset, and therefore, the lower body of the user is moved while the upper body of the user is fixed, or the upper body of the user is selectively moved while the lower body of the user is fixed. Consequently, repetitive symmetrical swing motion forward and backward is performed when viewed on the basis of the vertical direction of gravity, thereby achieving inertial exercise by action and reaction.

Also, exercise load force applied to the upper body or the lower body of the user movable by selective application of the weight mechanism 70 of the lever 7 or the brake wheel 8, the additional electromagnetic brake 86 and the amplifier 88 is variously adjusted, thereby achieving hip joint strengthening and rehabilitation exercise based on widely adjusted exercise load.

Figure 13:
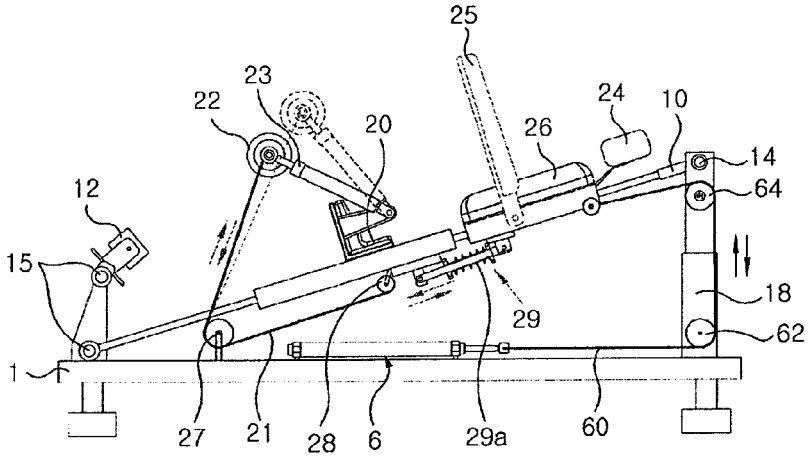
FIG. 13 is a perspective view illustrating a modification of the embodiment of the preset invention shown in FIGS. 1 to 12.
Figure 14:
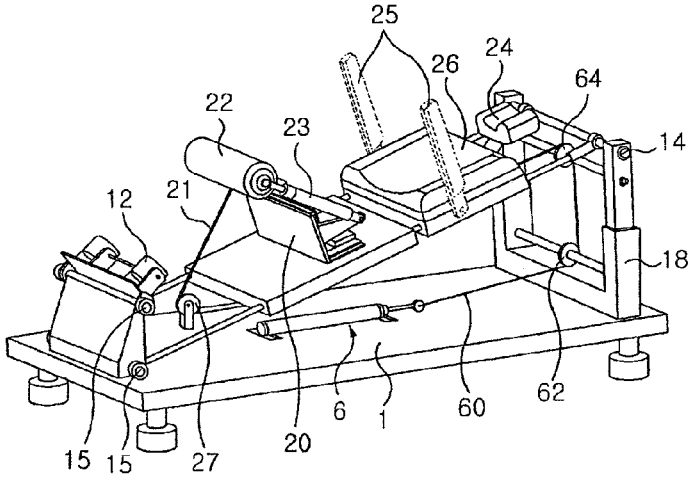
FIG. 14 is an operation state view of FIG. 13.
Figure 15:
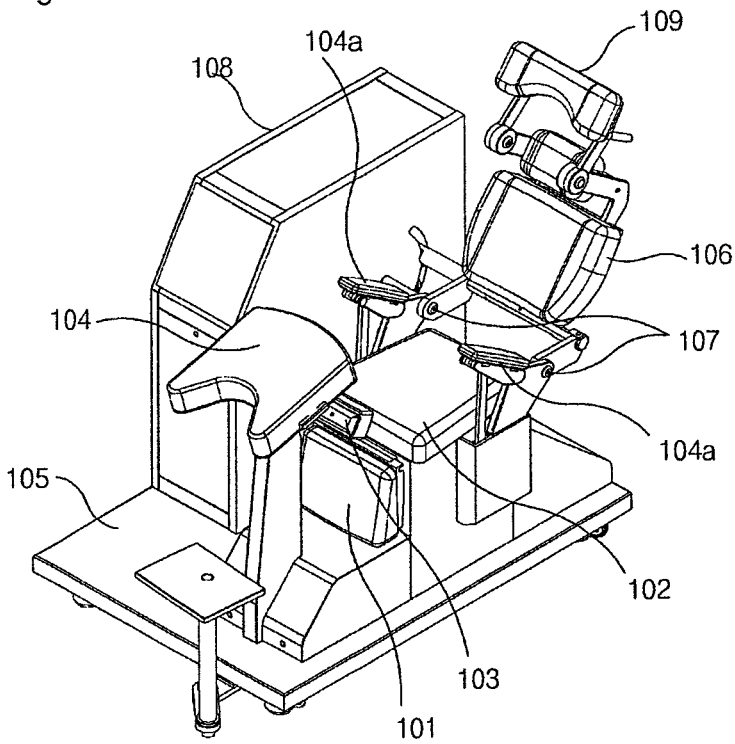
FIG. 15 is a perspective view illustrating the external appearance of a strengthening and rehabilitation exercise apparatus according to another embodiment of the present invention.
Figure 16:
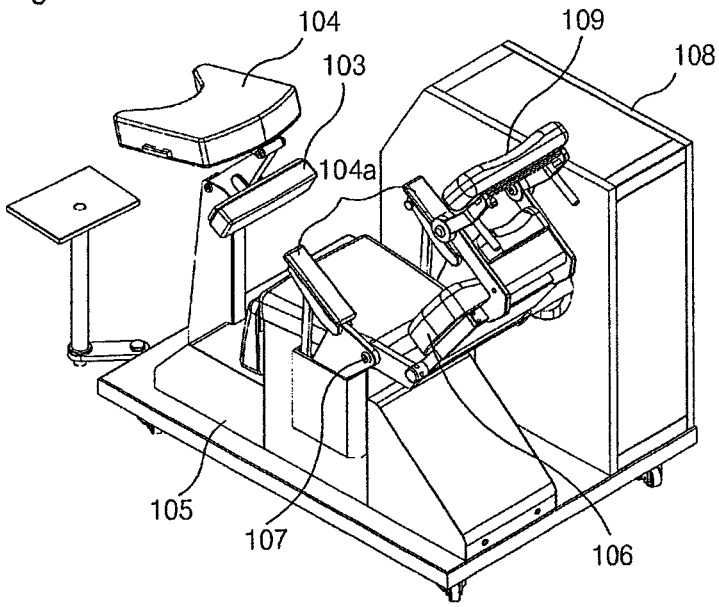
FIG. 16 is a perspective view of FIG. 15 when viewed in another direction.
Figure 17:
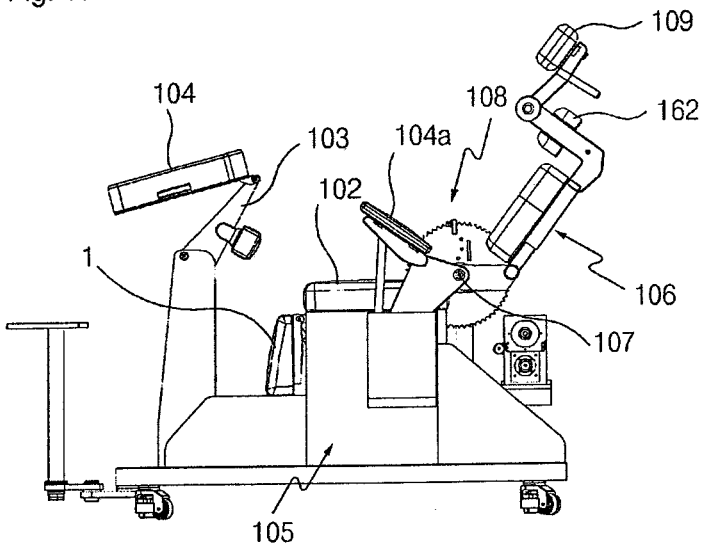
FIG. 17 is a partially omitted left side view of FIG. 15.
Figure 18:
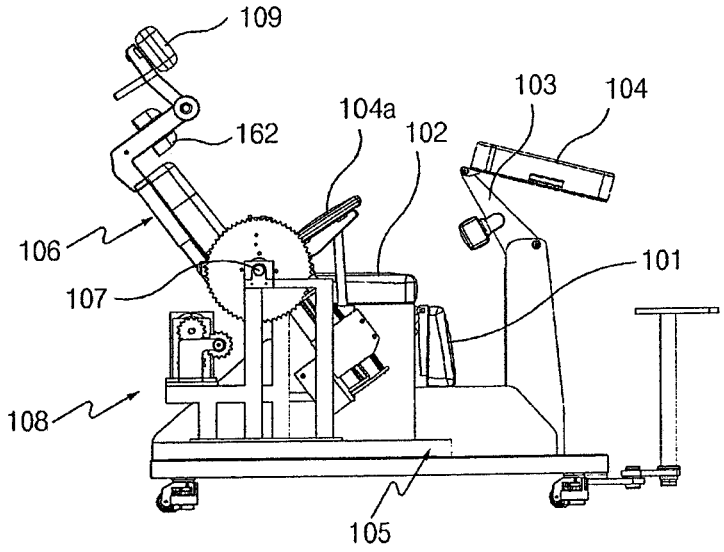
FIG. 18 is a partially omitted right side view of FIG. 16.
Figure 19:
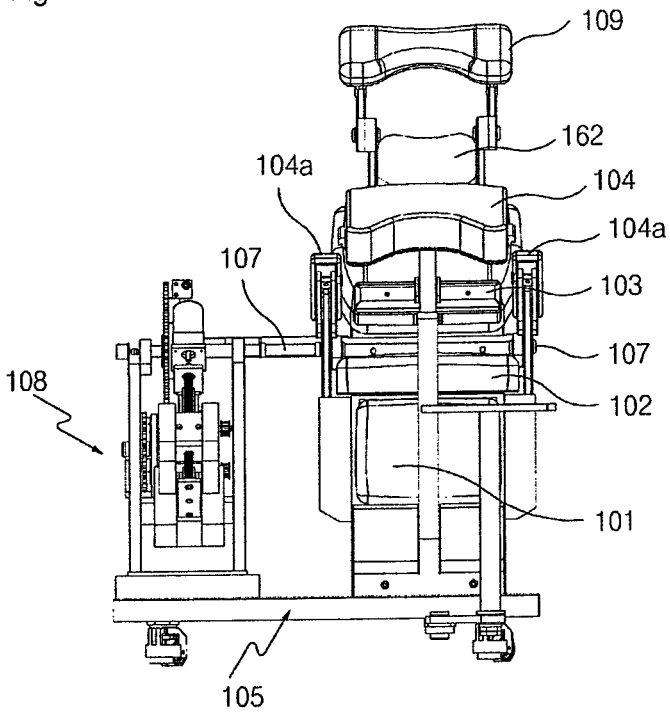
FIG. 19 is a partially omitted front view of FIG. 15.
Figure 20:
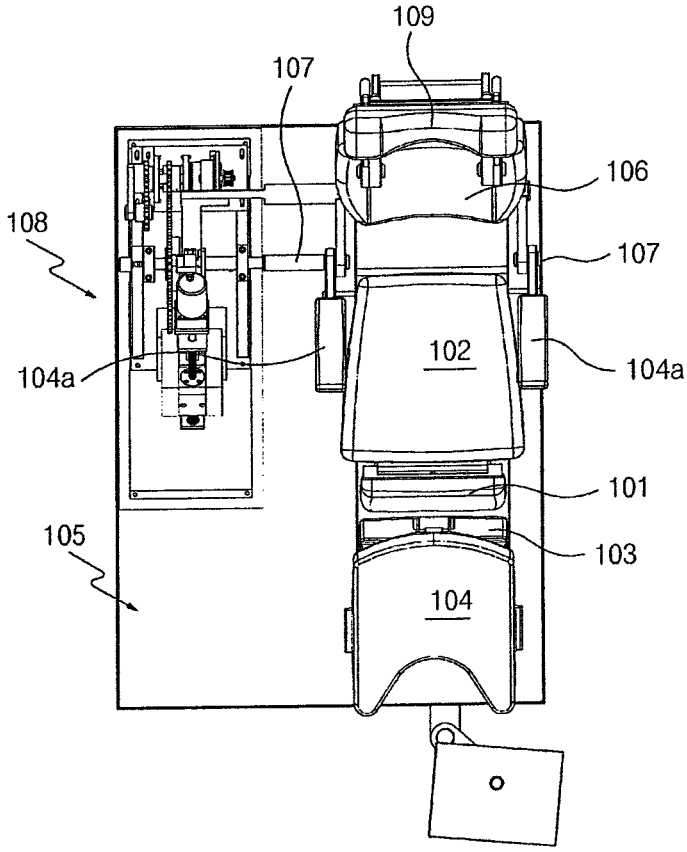
FIG. 20 is a partially omitted top view of FIG. 15.
Figure 21:
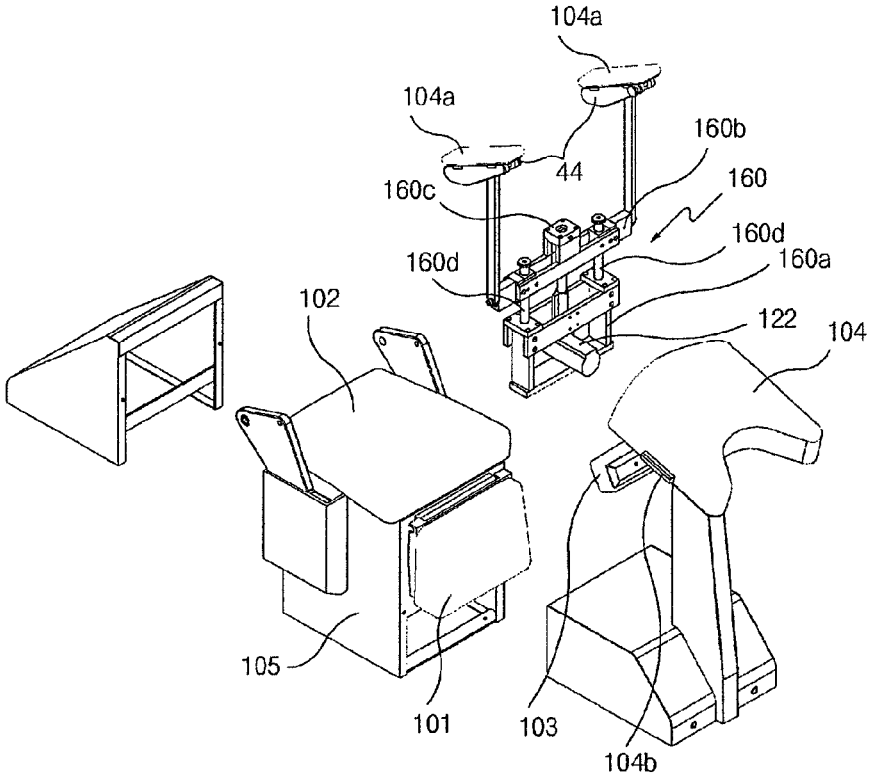
FIG. 21 is an exploded perspective view illustrating a technical mechanism for fixing the inguinal regions and the pelvis of a human body adopted in the present invention.
Figure 22:
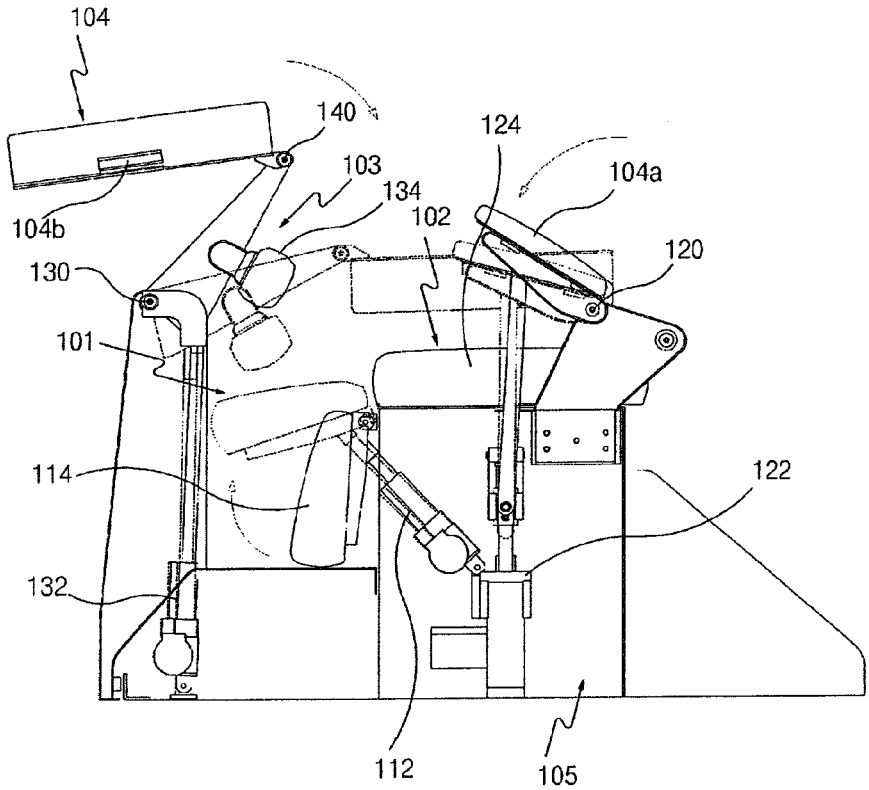
FIG. 22 is an assembled side view of FIG. 21 illustrating both a state before operation and a state during operation.

A modification of the embodiment shown in FIGS. 1 to 12 is illustrated in FIGS. 13 and 14. A hip joint strengthening and rehabilitation exercise apparatus is configured in a structure in which a footstool 12 is mounted at one side of a stationary frame 1 having a sliding board 10, an exercise frame 2 is slidably mounted at the sliding board 10, and an exercise resistance controller 6 interlocking with the exercise frame 2 is mounted at the stationary frame 1 such that hip joint strengthening and rehabilitation exercise is performed based on the footstool 12 in a tensioned state in which a lumbar joint of a user is pulled from the exercise frame 2 by the exercise resistance controller 6.

The exercise frame 2 includes a saddle 20 slidably mounted on the sliding board 10, an exercise lever 23 mounted at one side of the saddle 20, the exercise lever 23 having a knee exercise seat 22 at which a spring interlocking belt 21 is mounted, the exercise lever 23 being tensible, and a backboard 26 slidably mounted on the sliding board 10, the backboard 26 being provided with a pillow and an armrest 25.

The interlocking belt 21 has one side mounted at the knee exercise seat 22. The interlocking belt 21 extends via an idle pulley 27 mounted at the station frame 1 and an idle pulley 28 mounted at the bottom of the saddle 20. The other side of the interlocking belt 21 is mounted at an elastic support unit 29 mounted over the bottom of the saddle 20 and the backboard 26, the elastic support unit 29 having a spring 29*a*. Consequently, the interlocking belt 21 accommodates the displacement achieved by bending or straightening the knees while moving the interlocking belt 21.

Also, the lower part of the footstool 12 is hinged, and hinge parts 14 and 16 are provided at the upper and lower parts of the sliding board 10, respectively. An upper support stand 18 at which the upper hinge part 14 is mounted is configured such that the height of the upper support stand 18 can be adjusted.

In addition, the exercise resistance controller 6 is mounted at one side of the stationary frame 1. For example, the exercise resistance controller 6 is configured in the form of an elastic mechanism including a compression spring. A wire 60 is arranged between the exercise resistance controller 6 and the exercise frame 2 such that the wire 60 extends via idle rollers 62 and 64 mounted at the upper support stand 18 to pull the exercise frame 2 slidably mounted on the sliding board 10 and thus pull the lumbar joint of the user located at the saddle during exercise, thereby achieving strengthening and rehabilitation exercise in a tensioned state.

Therefore, when the user applies force to the footstool 12 using their feet and knees in a stable state in which the user sits down on the saddle 20, the feet of the user are placed on the footstool 12, the back of the user is placed on the backboard 26, the head of the user is placed on the pillow 24, and the arms of the user are placed on the armrest 25 and in a state in which the exercise frame 2 connected to the exercise resistance controller 6 via the wire 60 is pulled upward, it is possible for the user to perform hip joint strengthening and rehabilitation exercise.

Another embodiment of the present invention is illustrated in FIGS. 15 to 34, which will be described hereinafter in detail.

In this embodiment, a waist joint strengthening and rehabilitation exercise apparatus, which improves abdominal obesity and waist pain through exercise to bend or straighten the upper body of a user about the waist joint of the user while fixing legs or simultaneously fixing the legs and the pelvis of the user in a sitting or standing position includes a calf rest 101 provided at the front thereof to support calves such that the inguinal regions of the user or both the inguinal regions and the pelvis of the user are fixedly arranged in line in a supine position, an inguinal region and pelvis rest 102 provided at the rear of the calf rest 101 to support the inguinal regions of the user or simultaneously rest the inguinal regions and the pelvis of the user, a calf fixing unit 103 located above the calf rest 101 to press and fix the calves of the user when the waist joint strengthening and rehabilitation exercise apparatus is operated, and an inguinal region and pelvis fixing unit 104 located above the inguinal region and pelvis rest 102 to press and fix the inguinal regions and the pelvis of the user, thereby training the abdominal region and the waist of the user through exercise performed by bending and straightening the upper body of the user about the waist joint of the user.

Also, the strengthening and rehabilitation exercise apparatus according to this embodiment includes a stationary frame 105 to which the inguinal region and pelvis rest 102 is fixed. A backboard frame 160 constituting a backboard 106 is coupled to the stationary frame 105 such that the backboard frame 160 can angularly move about a rotation center shaft 107. The rotation center shaft 107 is positioned to coincide with the waist joint of a human body. An exercise resistance controller 108 is connected to the rotation center shaft 107 such that the exercise resistance controller 108 interlocks with the backboard frame 160.

In the strengthening and rehabilitation exercise apparatus according to this embodiment, the exercise resistance controller 108 is configured in a structure in which a lever 180 is mounted such that the lever 180 is symmetrically rotated about the rotation center shaft 107 while interlocking with the backboard 106 including the backboard frame 160, and the lever 180 is provided with a weight mechanism 182, thereby providing a gravity offset function to offset gravity of the backboard 106, an exercise load function to add and subtract exercise resistance, and an inertial exercise function to induce weight resistance to muscle and to eliminate a psychological burden using inertia.

Also, in the strengthening and rehabilitation exercise apparatus according to this embodiment, the calf rest 101 is mounted at one side of the stationary frame 105 such that the calf rest 101 can be rotated about a first hinge part 110, and the calf fixing unit 103 is mounted at the other side of the stationary frame 105 such that the calf fixing unit 103 can be rotated about a third hinge part 130. The inguinal region and pelvis fixing unit 104 is mounted at the calf fixing unit 103 such that the inguinal region and pelvis fixing unit 104 can be rotated about a fourth hinge part 140, and a pair of armrest-shaped press links 104*a* is mounted at the other end of the stationary frame 105 such that the armrest-shaped press links 104*a* can be rotated about a second hinge part 120. Press guide rails 104*b* are fixed at opposite sides of the inguinal region and pelvis fixing unit 104 such that the press links 104*a* press the press guide rails 104*b* in an operating state, and the pressing operation is released in a non-operating state. The calf rest 101, the press links 104*a*, and the calf fixing unit 103 are coupled to a first rectilinear screw motor 112, one side of which is mounted at the stationary frame 105, a second rectilinear screw motor 122, one side of which is mounted at the stationary frame 105, and a third rectilinear screw motor 132, one side of which is mounted at the stationary frame 105, respectively, to perform reciprocating movement, thereby fixing the inguinal regions of the user or the pelvis including the inguinal regions of the user or releasing the fixed state.

Figure 23:
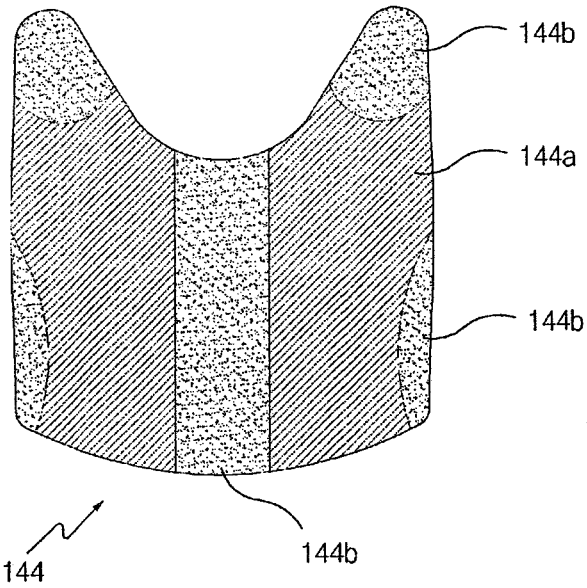
FIG. 23 is a top view illustrating an important part of a fixing press member of an inguinal region and pelvis fixing unit used in the present invention.
Figure 24:
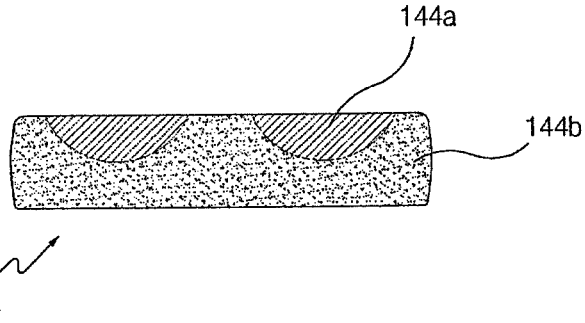
FIG. 24 is a sectional view illustrating an important part of FIG. 22.

At this time, the calf rest 101, the inguinal region and pelvis rest 102, the calf fixing unit 103, and the inguinal region and pelvis fixing unit 104 are connected with fixing press members 114, 124, 134, and 144, respectively, at regions contacting the human body. Each of the fixing press members 114, 124, 134, and 144 includes a soft part and a hard part configured to coincide with a skeleton of the human body. For example, as shown in FIGS. 23 and 24, the fixing press member 114 of the inguinal region and pelvis fixing unit 104 includes a soft part 144*a* and a hard part 144*b*, by which the inguinal region and pelvis fixing unit 104 is more effectively operated to fix the inguinal region and pelvis of the user.

Also, in the strengthening and rehabilitation exercise apparatus according to this embodiment, the backboard frame 160 is configured in a double shape such that the height of the backboard frame 160 can be adjusted. A headrest 162 is mounted at the upper part of the backboard frame 160 such that the headrest 162 can be moved backward and forward. An upper body fixing mechanism 109 is mounted at the upper part of the backboard frame 160. The exercise resistance controller 108 includes an additional brake wheel 184 mounted at the rotation center shaft 107 and an additional electromagnetic brake 186 and an amplifier 188 interlocking with the brake wheel 184.

Figure 25:
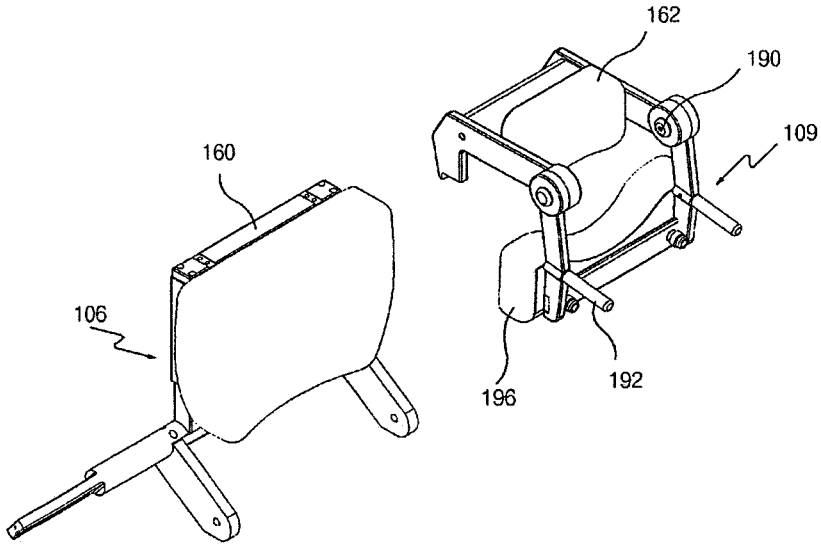
FIG. 25 is an exploded perspective view illustrating an upper structure of a backboard and an upper body fixing mechanism coupled with a headrest adopted in the present invention.
Figure 26:
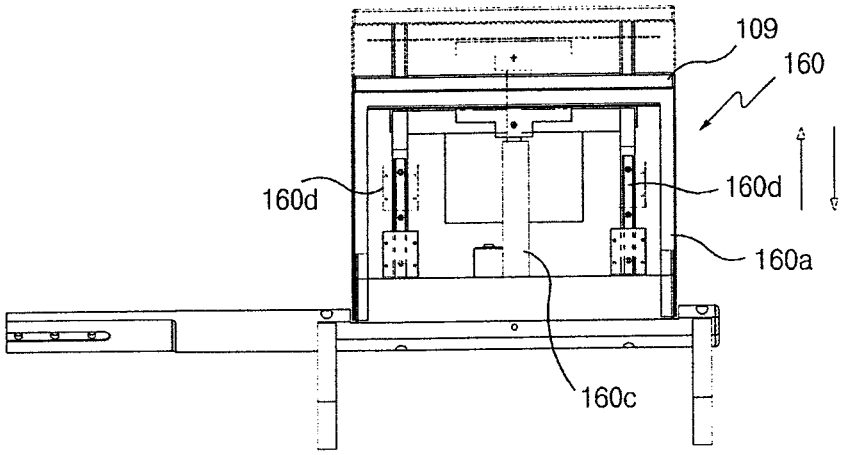
FIG. 26 is an operation state view illustrating an upper internal structure of the backboard of FIG. 25.

As shown in FIGS. 25 and 26, the backboard frame 160 is configured in a double shape including a lower stationary frame 160*a* and an upper movable frame 160*b*, a rectilinear screw motor 160*c* is mounted between the stationary frame 160*a* and the movable frame 160*b*, and guiders 160*d* are mounted at opposite sides of the rectilinear screw motor 160*c*. Consequently, the movable frame 160*b* moves upward or downward by forward rotation or reverse rotation of the rectilinear screw motor 160*c*, by which the height of the backboard frame 160 is adjusted.

Figure 28:
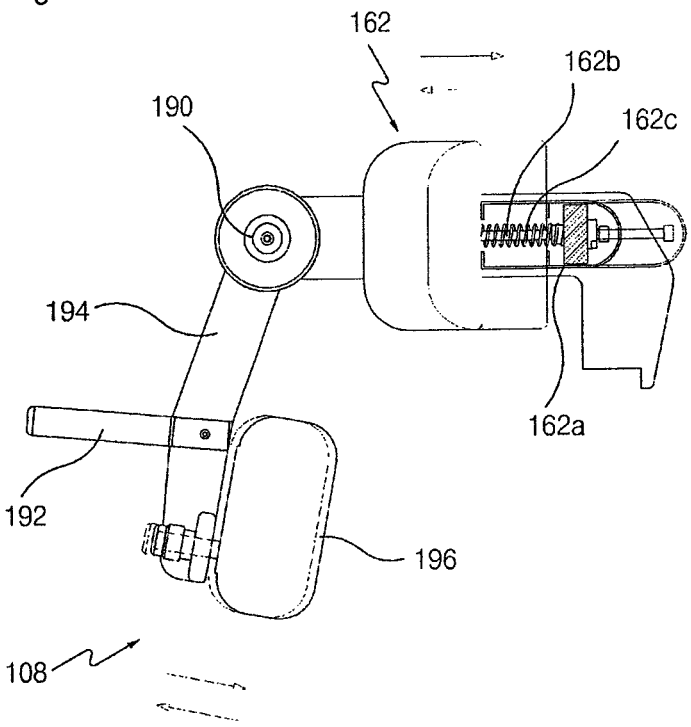
FIG. 28 is an operation state view illustrating the upper body fixing mechanism coupled with the headrest.
Figure 29:
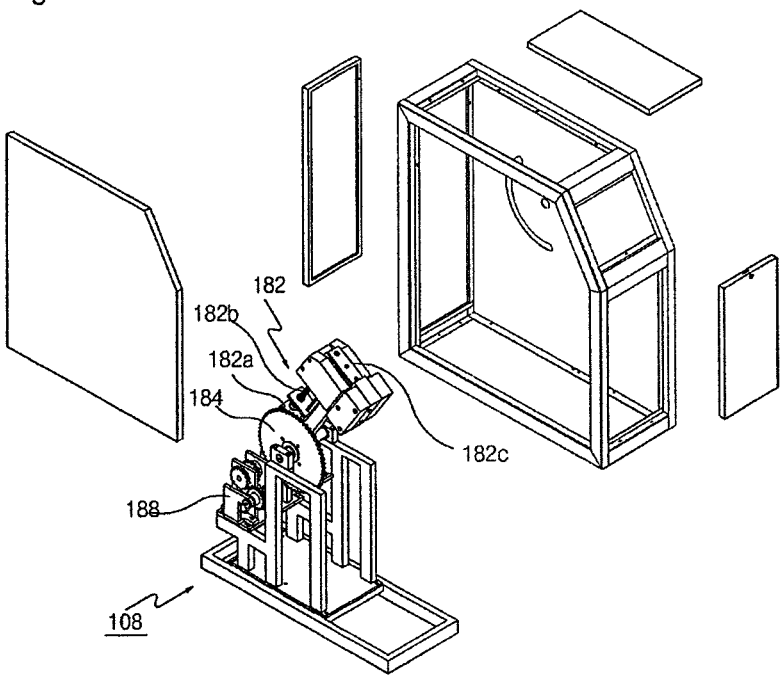
FIG. 29 is an exploded perspective view illustrating an exercise resistance controller adopted in the present invention.
Figure 30:
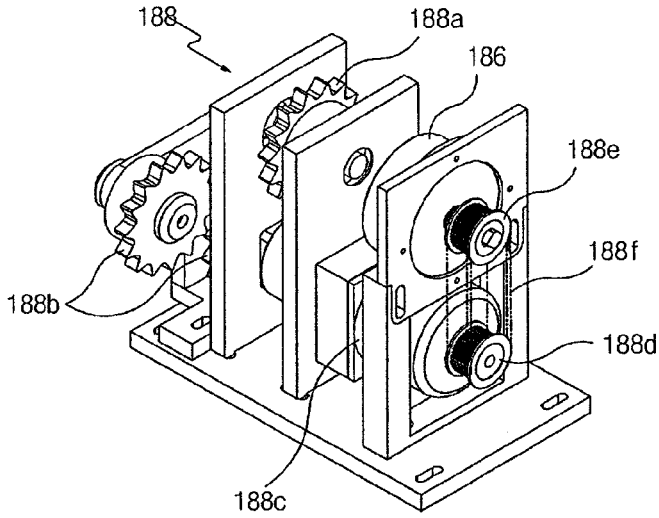
FIG. 30 is a perspective view illustrating the external appearance of an assembly of an electromagnetic brake and an amplifier of the exercise resistance controller.
Figure 31:
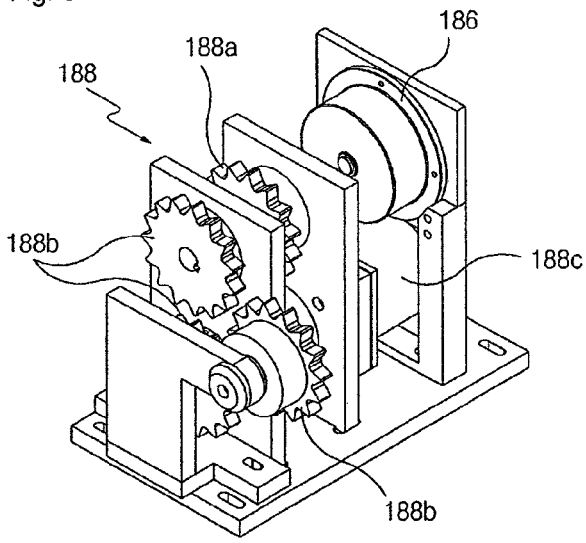
FIG. 31 is a perspective view of FIG. 30 when viewed in another direction.
Figure 32:
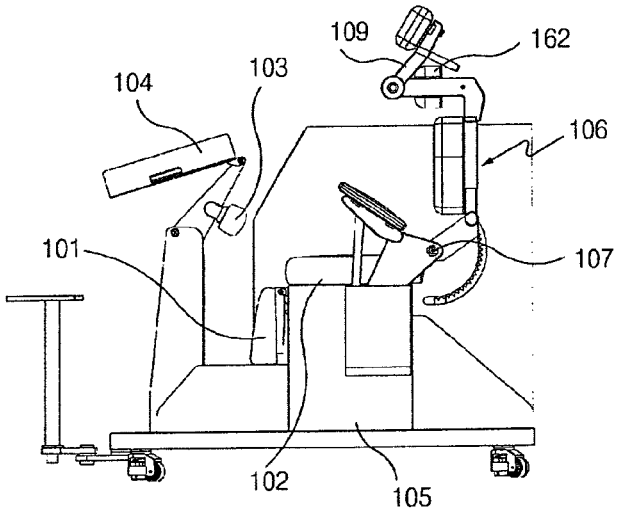
FIG. 32 is a side view illustrating a state of the strengthening and rehabilitation exercise apparatus according to the present invention before exercise.
Figure 33:
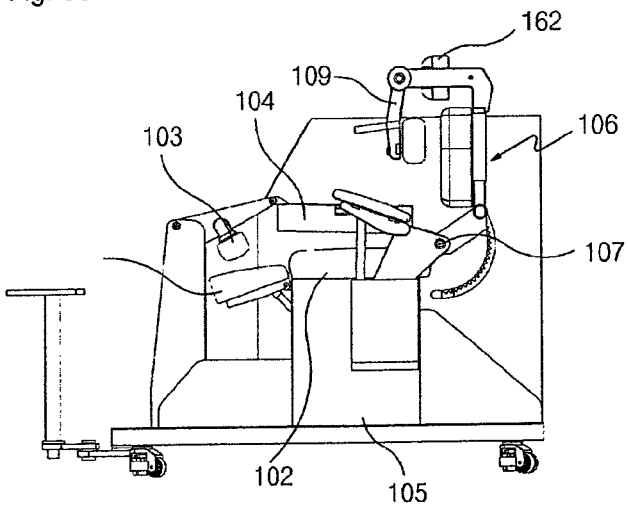
FIG. 33 is a side view illustrating a ready state of FIG. 32 immediately before exercise.
Figure 34:
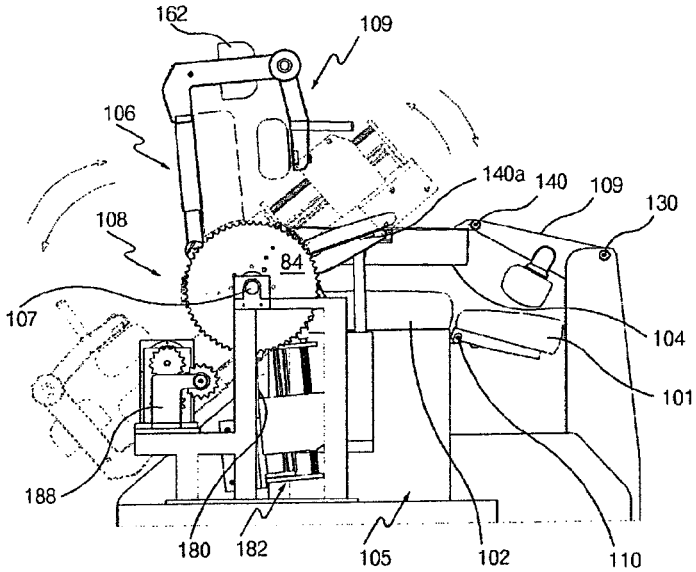
FIG. 34 is a side view illustrating an operation state of FIG. 32 during exercise.
Figure 35:
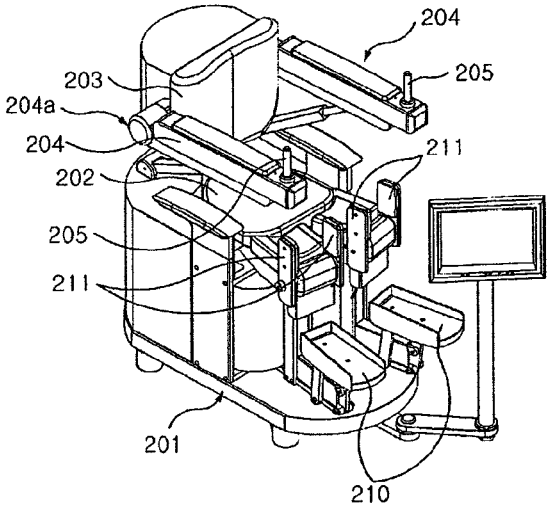
FIG. 35 is a perspective view illustrating the external appearance of a strengthening and rehabilitation exercise apparatus according to a further embodiment of the present invention.
Figure 36:
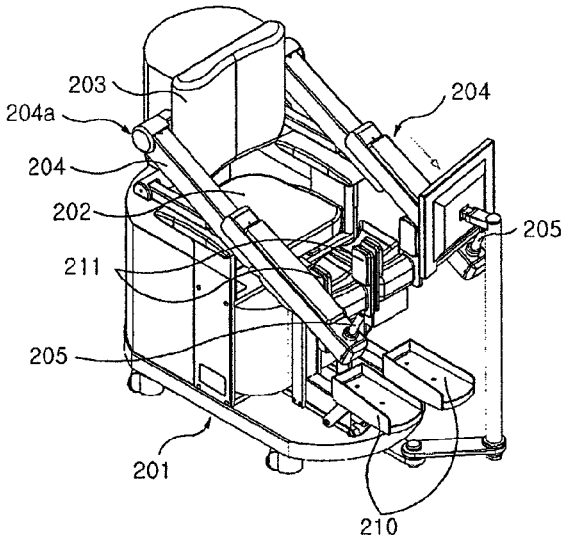
FIG. 36 is a partial operation state view of FIG. 35.
Figure 37:
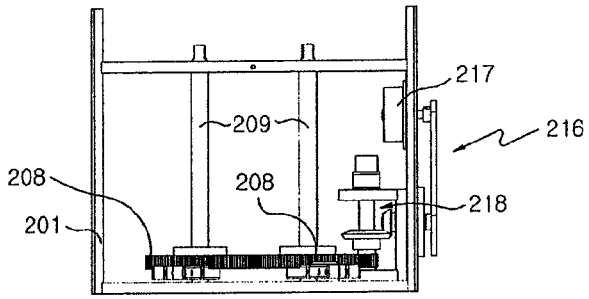
FIG. 37 is a front view illustrating an important part of a lower structure of FIG. 35.
Figure 38:
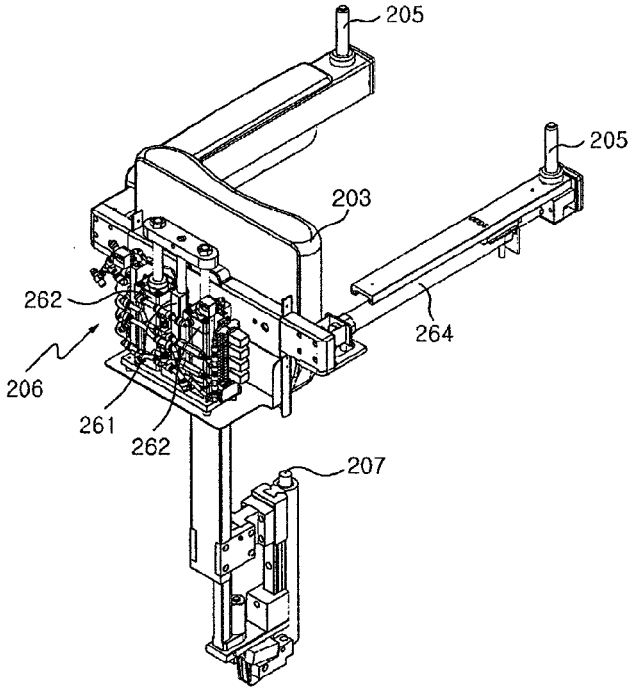
FIG. 38 is a partial perspective view illustrating an external structure of FIG. 35.
Figure 39:
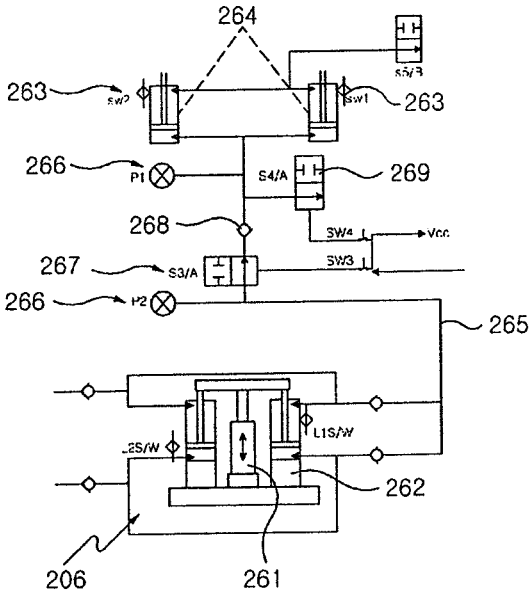
FIG. 39 is a systematic view illustrating a pneumatic system of the embodiment shown in FIGS. 35 to 38.

Also, as shown in FIG. 28, the headrest 162 is fixed to a headrest frame 162*a* fixedly mounted at the upper part of the backboard frame 160. The headrest 162 may be configured in a structure in which a spring 162*c* is fitted on a rear movable shaft 162*b* such that the headrest 162 can move forward and backward in a state in which the headrest 162 is elastically supported by the spring 162*c*.

Figure 27:
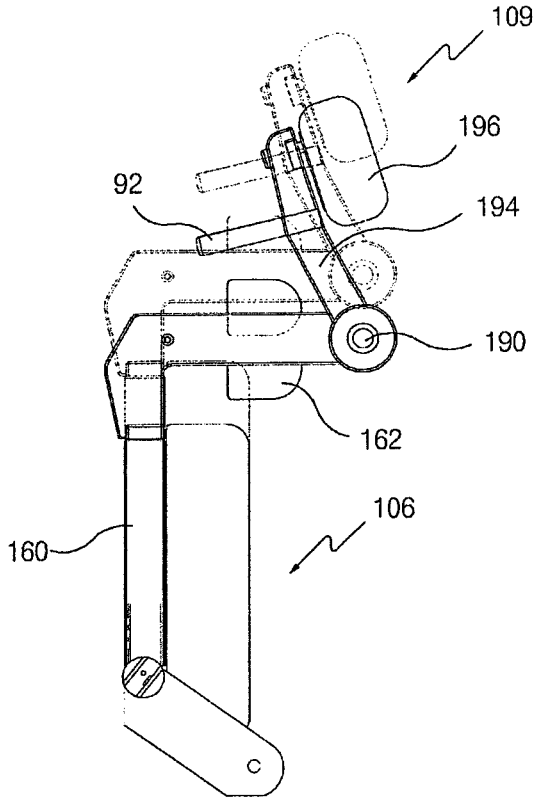
FIG. 27 is an assembled side view of FIG. 25.

Also, as shown in FIGS. 25, 27, and 28, the upper body fixing mechanism 109 is configured in a structure in which a support frame 194 having a vertically movable grip 192 is mounted at a tip end of the headrest frame 162*a* such that the support frame 194 can be rotated about a hinge part 190, and a fixing pad 196 is mounted at one end of the support frame 194, i.e., the side opposite to the grip 192.

As shown in FIGS. 17, 18, 19, 20, and 21 to 31, the exercise resistance controller 108 is configured in a structure in which the lever 180 is mounted such that the lever 180 is symmetrically rotated about the rotation center shaft 107 while interlocking with the backboard 106 including the backboard frame 160, the lever 180 is provided with the weight mechanism 182, the brake wheel 184 is mounted at the rotation center shaft 107, and the electromagnetic brake 186 and the amplifier 188 interlocks with the brake wheel 184, the weight mechanism 182 is threadedly coupled to a screw rod 182*b* configured to be spin rotated by a drive motor 182*a* such that a weight 182*c* of the weight mechanism 182 moves on the lever 180 along the screw rod 182*b* according to a direction in which the drive motor 182*a* is rotated, i.e., a forward direction or a reverse direction of the drive motor 182*a*, thereby achieving displacement thereof.

Also, the electromagnetic brake 186 and the amplifier 188 include a chain gear 188*a* interlocking with the brake wheel 184, a chain gear group 188*b* including a plurality of chain gears interlocking with the chain gear 188*a*, a direct current motor 188*c* interlocking with the chain gear group 188*b*, an electromagnetic brake 186 interlocking with the direct current motor 188*c* via timing gears 188*d* and 188*e* and a timing belt 188*f*.

The electromagnetic brake 186 is configured such that exercise torque is transmitted to the electromagnetic brake 86 by binding of powder and frictional force between the powder and the operation surface thereof due to magnetic flux generated when electric current is supplied to a coil, and necessary exercise torque is selected by controlling applied voltage, thereby adjusting a direction and a load during strengthening and rehabilitation exercise.

Hereinafter, the operation of the strengthening and rehabilitation exercise apparatus with the above-stated construction according to the present invention will be described in detail.

A process of fixing legs of a user or simultaneously fixing the legs and pelvis of the user as a exercise preparation process is carried out as follows.

First, the user sits down on the calf rest 44 such that the hips and the inguinal regions of the user are located on the inguinal region and pelvis rest 102, and the calves of the user are located on the calf rest 101, and operates the rectilinear screw motor 12. As a result, the calf rest 101 is angularly moved about the first hinge part 110. Consequently, a tip end of the calf rest 101 is raised, and therefore, the calf rest 101 is stretched such that the calves of the user can be placed on the calf rest 101.

Subsequently, the inguinal region and pelvis fixing unit 104 is angularly moved about the fourth hinge part 140 such that the upper body of the user is coupled to the armrest-shaped press links 104*a*, and the press guide rails 104*b* of the inguinal region and pelvis fixing unit 104 are coupled to the fixing press member 144 of the armrest-shaped press links 104*a*. Also, the calf fixing unit 103 interlocking with the inguinal region and pelvis fixing unit 104 are angularly moved about the third hinge part 130 by the operation of the third rectilinear screw motor 132. As a result, the calf fixing unit 103 presses the shanks located above the calves of the user. At this time, when the second rectilinear screw motor 122 is operated, the press links 104*a* are angularly moved about the second hinge part 120, with the result that the press links 104*a* move downward, and therefore, the press links 104*a* press the inguinal regions of the user or simultaneously press the inguinal regions and the pelvis of the user, thereby fixing the inguinal regions of the user or simultaneously fixing the inguinal regions and the pelvis of the user.

At this time, the operations of the first to third rectilinear screw motors 112, 122, and 132 are adjusted, according to a shape or a condition of the body including the calves, the inguinal regions, and the pelvis of the user, to adjust the press fixing state. By this operation, the preparation process for fixing the legs and pelvis of the user is completed.

Subsequently, the user operates the direct current screw motor 160*c*, while leaning against the backboard 106, to move the movable frame 160*b* upward or downward, thereby adjusting the size of the backboard 106 according to the shape of the user. The upper body fixing mechanism 109 is adjusted by the grip 192. The upper body fixing mechanism 109 is angularly moved forward about the hinge part 190 such that the fixing pad 196 is placed above the chest of the user to fix the upper body of the user to the backboard 106. In this way, the exercise preparation process is completed.

Also, the exercise resistance controller 108 is adjusted according to the state of the user. To this end, an adjustment method using the lever 180 and the weight mechanism 182 or an adjustment method using the brake wheel 184, the electromagnetic brake 186, and the amplifier 188 may be adopted. Alternatively, both the adjustment methods may be simultaneously adopted.

When the exercise preparation process is completed as described above, the user performs abdominal and waist exercise while bending or straightening the upper body of the user together with the backboard 106 about the waist joint of the user.

At this time, the position of the lever 180 opposite to the backboard 106 and the upper body fixing mechanism 109 and the position of the weight 182*c* of the weight mechanism 182 are adjusted by the drive motor 182*a* such that the lever 180 and the weight 182*c* of the weight mechanism 182 are moved to positions at which load gravity generated by the backboard 106 and the upper body fixing mechanism 109 coupled to the backboard 106 is offset. As a result, it is possible for the user to perform exercise in a no load state in which gravity is offset. Also, the upper body bending or straightening process may be performed in an inertial state by virtue of inertial force caused due to action and reaction.

Of course, the change of exercise load force due to displacement of the upper body of the user may be variously adjusted using the weight mechanism 182 or the electromagnetic brake 186 and the amplifier 188, thereby training the abdominal region and the waist of the user based on a wide range of exercise loads and greatly contributing to the improvement of abdominal obesity and waist pain.

FIGS. 35 to 42 illustrate a stretching apparatus configured to stretch the back or shoulders of a user, to stretch a waist joint and muscles around the waist joint, and to train an adductor muscle and an abductor muscle of a pelvic joint according to a further embodiment of the present invention. The stretching apparatus configured to solve pain of a shoulder muscle, such as a stiff shoulder muscle, includes a seat board 202 provided at a stationary frame 201, a backboard 203 provided at the rear of the seat board 202, armrests 204 provided at opposite sides of the backboard 203 such that angles of the armrests 204 can be changed about hinge parts 204*a*, and grips 205 provided at the armrests 204 such that the grips 205 can slide forward and backward. A first exercise resistance controller 206 to transmit exercise resistance force to the grips 205 includes a pneumatic system that can be controlled by a valve and a sensor. Consequently, it is possible to perform shoulder stretching through the stretching apparatus.

Also, the backboard 203 is mounted at a rotary shaft 207 of the stationary frame 201. Horizontal rotation about the spine of the user is achieved using the armrests 204 including the grips 205 and the backboard 203 while the pelvis and the legs of the user are fixed. Consequently, it is possible to stretch the waist joint and the muscles around the waist joint.

Also, a pair of main shafts 209 interlocking with each other by main shaft gears 208 which engage with each other is mounted at the stationary frame 201, footstools 210 interlocking with the main shafts 209 are mounted in front of the main shafts 209 below the main shafts 209, inguinal region exercise boards 211 interlocking with the main shafts 200 are mounted in front of the main shafts 209 above the main shafts 209, and an additional second exercise resistance controller 216 interlocking with the main shafts 208 includes a powder brake 217 and an amplifier 218, thereby training the adductor muscle and the abductor muscle of the pelvic joint of the user.

In addition, the first exercise resistance controller 206 to transmit exercise resistance force to the grips 205, which is embodied by a pneumatic system that can be controlled by a valve and a sensor, includes an air cylinder 262 configured to be operated by rectilinear movement of a reduction motor screw 261, an exercise load cylinder 264 mounted inside the armrests 204, the exercise load cylinder 264 interlocking with the grips 205, the exercise load cylinder 264 having an excessive air input detection sensor 263, and a pneumatic pressure supply control line 265 connected between the air cylinder 262 and the exercise load cylinder 264 for controlling the supply of pneumatic pressure. A pair of electronic pressure sensors 266 is mounted in the middle of the pneumatic pressure supply control line 265, and an air pressurization solenoid valve 267, a backward flow prevention check valve 286, and an exhaust solenoid valve 269 are mounted between the electronic pressure sensors 266.

According to the above embodiment, therefore, it is possible to stretch the back or shoulders of the user, to stretch the waist joint and muscles around the waist joint, and to train the adductor muscle and the abductor muscle of a pelvic joint. In this way, the strengthening and rehabilitation exercise is performed.

That is, the user sits down on the seat board 202, puts his/her feet on the footstool 210, leans against the backboard 203, and straightens his/her arms on the armrests 204. In this state, the user performs angular displacement downward about the hinge part 204*a* while holding the grips 205. In this way, a stretching preparation process is completed. At this time, when the first exercise resistance controller 26 is electrically operated, pneumatic pressure generated therein by the operation of the air cylinder 262 performed by the reduction motor screw 261 operates the exercise load cylinder 261 via the pneumatic pressure supply line 265. As a result, the grips 205 are moved forward from a state of FIG. 35 to a state of FIG. 36, thereby performing stretching of shoulders and back of the user through the hands of the user.

At this time, the pneumatic pressure supplied to the exercise load cylinder 261 via the pneumatic pressure supply line 265 is detected by the electronic pressure sensor 266. In a low pneumatic pressure state in which the pneumatic pressure is low, the internal pressure is increased by the air pressurization solenoid valve 267. On the other hand, when the pneumatic pressure is excessive, the exhaust solenoid valve 269 is opened to lower the pressure. In a state in which appropriate pressure is maintained, both the valves 267 and 268 are closed to maintain the same pressure state.

Figure 40:
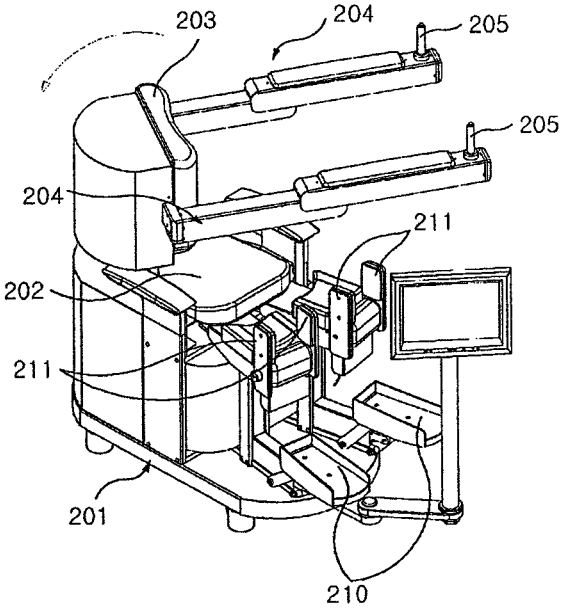
FIGS. 40 and 41 are perspective views illustrating an example of exercise performed by the embodiment shown in FIGS. 35 to 39.
Figure 41:
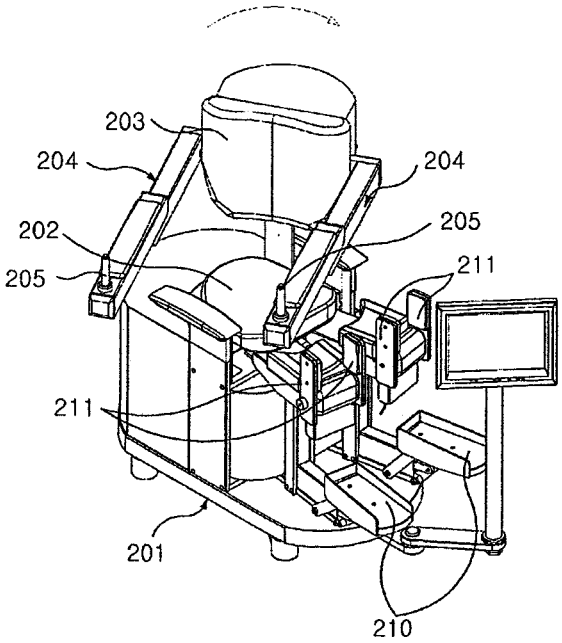

Subsequently, in a fixed state in which the pelvis and legs of the user are not moved, swing motion caused by the horizontal rotation of the armrests 204 about the rotary shaft 207 provided at a position corresponding to the spinal line of the user is achieved as shown in FIGS. 40 and 41. As a result, the stretching exercise through the horizontal rotation of the waist joint of the user is performed, thereby achieving the waist joint strengthening and rehabilitation exercise through the stretching of the strained waist joint and the muscle around the waist joint.

Figure 42:
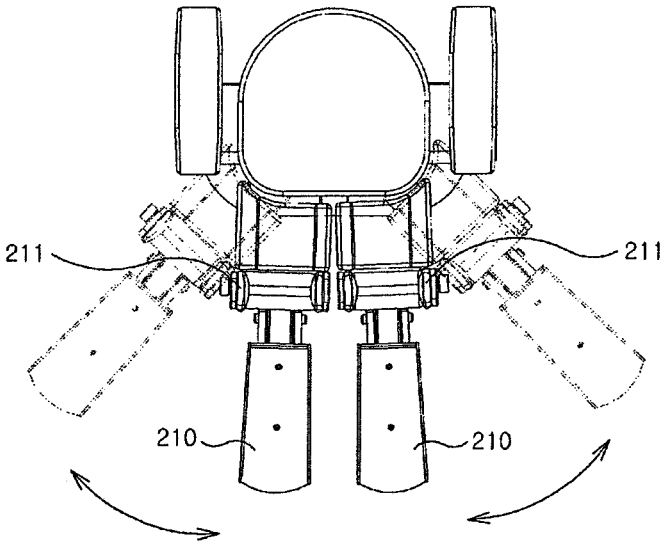
FIG. 42 is a top view illustrating another example of exercise performed by the embodiment shown in FIGS. 35 to 39.

Also, when the user performs an exercise of increasing or decreasing the distance between his/her legs about the hip joint of the user, as shown in FIG. 42, in a state in which the user sits down on the seat board 202, puts his/her legs on the footstool 210, and places his/her inguinal regions on the inguinal region exercise boards 211 without movement of the upper body of the user, inguinal region exercise resistance force is generated by the second exercise resistance controller 216 constituted by the powder clutch 218 and the amplifier 218. The exercise resistance force generated by the second exercise resistance controller 216 is transmitted to the inguinal region exercise boards 211 interlocking with the main shafts 209 via the engaged main shaft gears 208 and the main shafts 209, thereby achieving the inguinal region strengthening and rehabilitation exercise. As a result, a sphincteral muscle, a pectineous muscle, an adductor muscle, and an adductor muscle of the pelvis of the user are trained through adductor and adductor exercise, and therefore, urinary incontinence, a urination disorder, and a bowel movement disorder are improved.

Above, the second exercise resistance controller 216 was described as being constituted by the powder clutch 218 and the amplifier 218. However, a pneumatic pressure cylinder or a different exercise resistance controller may be appropriately adopted.

As is apparent from the above description, the strengthening and rehabilitation exercise apparatus according to the present invention is capable of effectively training a human body including a pelvis, a waist, an abdominal region, a back, and shoulders of the human body while reducing the number of exercise repetitions and exercise burden. Consequently, the present invention has industrial applicability.

The invention claimed is:

1. An exercise apparatus comprising:

a stationary frame having left (L) and right (R) sides;

separate L and R rotary shafts separately supported by the L and R sides of the stationary frame, respectively, wherein the rotary shafts jointly define a first collinear, horizontal axis between the L and R sides of the stationary frame;

an exercise frame including an upper frame and a lower frame, wherein the upper frame is configured to support an upper body portion and is supported at its L and R sides by the L and R rotary shafts at the first axis and is configured for independent rotation about the rotary shafts, wherein the lower frame is configured to support a lower body portion and is supported at its L and R sides by the L and R rotary shafts at the first axis and is configured for independent rotation about the rotary shafts, one of the upper and lower frames being fixable at a specified position as the other of the upper and lower frames is movable from the specified position, and wherein the lower frame comprises a calf rest configured for independent back-and-forth swinging motion, the calf rest defining lower body support regions being conformable to portions of the lower body of a user and extending to a terminal portion of the lower frame, and an exercise resistance controller including, a resistance controller lever configured for rotary motion about the rotary shafts and rotationally linked to the upper frame, and a weight mechanism comprising a weight configured for radial back-and-forth motion along the resistance controller lever in order to provide a greater or lesser degree of gravitational offset to rotation of the upper frame about the rotary shafts.

2. The apparatus of claim 1 wherein the weight is positioned along the resistance controller lever for substantially effortless movement of said upper frame.

3. The apparatus of claim 1 wherein the exercise resistance controller further comprises:

a brake wheel rotating about at least one of the rotary shafts and coupled to at least one of the upper frame or the lower frame; and an electromagnetic brake coupled to the brake wheel for providing exercise torque to at least one of the upper and lower frames.

4. The apparatus of claim 3 wherein the exercise resistance controller further comprises:

a rotary roller; and a belt engaging the rotary roller, wherein the belt links the upper frame to the resistance controller lever so that the upper frame and the resistance controller lever rotate in opposite directions.

5. The apparatus of claim 1, wherein the exercise apparatus further comprises:

a pin; and a pin recess in at least one of the upper or lower frames such that when the pin is positioned in the pin recess, that frame having the pin recess is prevented from rotation about the first axis.

6. The apparatus of claim 1, wherein the upper frame comprises a chest rest, a neck rest, arm rests and a head rest.

7. The apparatus of claim 1, wherein the lower frame further comprises an inguinal region rest and a pelvic region rest.

8. The apparatus of claim 7, wherein the calf rest is supported by a four-axis link for the back-and-forth swinging motion.

9. The apparatus of claim 1, wherein the upper and lower frames have upper and lower portions, wherein the upper frame is supported along its lower portion by the rotary shafts and wherein the lower frame is supported along its upper portion by the rotary shafts.

10. An exercise apparatus comprising:

a stationary frame having left (L) and right (R) sides;

separate L and R rotary shafts separately supported by the L and R sides of the stationary frame, respectively, wherein the rotary shafts jointly define a first collinear, horizontal axis between the L and R sides of the stationary frame;

an exercise frame including an upper frame and a lower frame, wherein the upper frame is configured to support an upper body portion and is supported at its L and R sides by the L and R rotary shafts at the first axis and is configured for independent rotation about the rotary shafts, wherein the lower frame is configured to support a lower body portion and is supported at its L and R sides by the L and R rotary shafts at the first axis and is configured for independent rotation about the rotary shafts, one of the upper and lower frames being fixable at a specified position as the other of the upper and lower frames is movable from the specified position, and wherein the lower frame comprises a calf rest configured for independent back-and-forth swinging motion, the calf rest defining lower body support regions being conformable to portions of the lower body of a user and extending to a terminal portion of the lower frame, the calf rest being supported by a four-axis link for the back-and-forth swinging motion, and wherein the four-axis link comprises:

L and R inguinal exercise levers, wherein the L and R inguinal exercise levers rotate in parallel about the L and R rotary shafts, and about L and R first hinge shafts which directly support the lower portion of the calf rest;

L and R rear levers, wherein the L and R rear levers rotate in parallel about L and R third hinge shafts which are supported by the stationary frame, and about L and R second hinge shafts which directly support the upper portion of the calf rest;

the L and R rotary shafts; and the L and R first, second and third hinge shafts.

11. The apparatus of claim 10 wherein each pair of L and R first, second and third hinge shafts respectively and jointly define a separate, collinear and horizontal axis between the L and R sides of the stationary frame.

12. The apparatus of claim 11 wherein at least one inguinal exercise lever further comprises:

a plurality of connection members linking the inguinal exercise lever to the upper portion of the calf rest; and at least one motor for adjusting the position of the connection members, wherein the position of the calf rest is adjusted so as to set the length of support for an inguinal body portion.

* * * * *